US007628737B2

(12) United States Patent
Kowallis et al.

(10) Patent No.: US 7,628,737 B2
(45) Date of Patent: Dec. 8, 2009

(54) REPETITION SENSOR IN EXERCISE EQUIPMENT

(75) Inventors: Rodney C. Kowallis, Providence, UT (US); Darren C. Ashby, Richmond, UT (US); Robert D. Ashby, Collinston, UT (US); James Boyd Gerber, Hyrum, UT (US); Chad J. Earl, Logan, UT (US); Rick W. Hendrickson, River Heights, UT (US)

(73) Assignee: Icon IP, Inc., Logan, UT (US)

( * ) Notice: Subject to any disclaimer, the term of this patent is extended or adjusted under 35 U.S.C. 154(b) by 504 days.

(21) Appl. No.: 10/916,687

(22) Filed: Aug. 11, 2004

(65) Prior Publication Data

US 2006/0035768 A1 Feb. 16, 2006

(51) Int. Cl.
*A63B 21/06* (2006.01)

(52) U.S. Cl. ..... 482/94; 482/1

(58) Field of Classification Search ..... 482/1–8, 482/92–98, 148

See application file for complete search history.

(56) References Cited

U.S. PATENT DOCUMENTS

| | | | | |
|---|---|---|---|---|
| 4,750,738 | A * | 6/1988 | Dang | 482/5 |
| 4,907,795 | A | 3/1990 | Shaw et al. | |
| 6,027,429 | A * | 2/2000 | Daniels | 482/5 |
| 6,342,028 | B1 | 1/2002 | de Sane | |
| 7,008,356 | B2 * | 3/2006 | Hung | 482/140 |
| 7,197,029 | B1 * | 3/2007 | Osterhout et al. | 370/353 |
| 2005/0049121 | A1 * | 3/2005 | Dalebout et al. | 482/93 |
| 2005/0272564 | A1 * | 12/2005 | Pyles et al. | 482/54 |

OTHER PUBLICATIONS

3422 Hall-Effect, Direction-Detection Sensor, Copyright 2001, 2003, Allegro MicroSystems, Inc., available online at www.allegromicro.com, p. 1-12.

A3425 Ultra-Sensitive Dual-Channel Quadrature Hall-Effect Bipolar Switch, Copyright 2005, Allegro MicroSystems, Inc., available online at www.allegromicro.com, p. 1-21.

* cited by examiner

*Primary Examiner*—Lori Amerson
(74) *Attorney, Agent, or Firm*—Workman Nydegger

(57) ABSTRACT

An exercise repetition sensor comprises an electricity generator, such as an electricity generator, which is coupled to an exercise system, where the electricity generator is capable of sensing exercise movements of any size or intensity on the exercise system. The electricity generator can be based on a number of electrical, magnetic, or optical sensing principles. For example, an electricity generator comprising an electricity generator includes a spindle that is coupled to one or more parts that move in proportion to an applied force. The voltage-generator generates an electrical current as the spindle moves, and sends the electrical current to an electronic display interface. In one embodiment, the voltage-generator sends a positive direct current through one of two circuit wires to the electronic console, such that the electronic console can immediately identify that the user has performed an exercise repetition.

36 Claims, 16 Drawing Sheets

REPETITION SENSOR IN EXERCISE EQUIPMENT

BACKGROUND OF THE INVENTION

1. The Field of the Invention

The present invention relates to systems, methods, and apparatus for identifying and measuring exercise repetitions in an exercise system.

2. Background and Relevant Art

Exercise systems, increasingly found in both home and institutional settings, are generally categorized into one of two groups: aerobic exercise systems (or "aerobic devices") and anaerobic exercise systems (or "anaerobic devices"). Aerobic systems generally comprise machines or apparatus configured so that a user can elevate his/her heart rate by exercising continuously between a moderate and intense degree, over a relatively prolonged period of time. Aerobic systems generally comprise exercise devices such as treadmills, steppers, skiers, rowers, ellipticals, and so forth.

Anaerobic systems, by contrast, generally comprise machines or apparatuses configured to provide a user with brief, relatively intense resistance over a relatively short period of time. Anaerobic systems generally comprise exercise devices such as press systems (bench press, leg press, etc.), based on free weights or weight stacks, bar bell and dumbbell systems, cable and pulley systems, and utilize one or more adjustable resistance members.

An increasingly important component for exercise systems is the ability to accurately monitor the user's progress through a given workout program, which may include exercises on both aerobic and anaerobic systems. Many aerobic exercise devices implement some form of basic electronic monitoring apparatus that counts the duration the user has been exercising on the device, and then provides the information to the user in the form of an electronic display. More complicated aerobic systems implement a more sophisticated electronic monitoring apparatus that may further calculate the slope, speed, or resistance level provided to the user on the aerobic system, the total calories burned, the calories burned per minute, distance traveled, and, in some instances, comparisons with standardized data (e.g., data related to the user's prior workouts).

Unfortunately, electronic monitoring, as described herein, has been limited primarily to aerobic exercise systems, rather than anaerobic exercise systems, due in part to the way that aerobic exercises are typically performed, and the way in which the aerobic exercise data is counted. In particular, for example a conventional odometer or speedometer can be added to rotating parts of aerobic systems such as the rotating wheels in treadmills, ellipticals, and so on. The data obtained from these monitoring apparatuses can then be combined to provide the user with the aforementioned results.

Anaerobic devices, by contrast, are not normally suited for these types of monitoring apparatuses, since anaerobic systems do not typically rely on continuously rotating parts. Additionally, the amount of work a user undertakes is more directly tied to resistance and repetitions rather than being tied to time or speed. In particular, anaerobic exercises comprise a wide range of motions which one would not ordinarily couple to a rotation-based or other typically used monitoring device, such as a speedometer, odometer, or heart rate sensor. For example, a user may make long sweeping motions of roughly similar length in the form of a bench press on one gripping bar, but make only small motions of highly variable length when performing a wrist curl with the same gripping bar. Coupling motions such as these to a speedometer, odometer, etc. does not ordinarily provide the type of information desired to accurately assess the quality or quantity of work performed with most anaerobic exercisers.

Thus, where exercise device manufacturers have tried to implement electronic monitoring functionality with anaerobic exercise devices, manufacturers have been limited primarily to providing a user only with an electronic indication of the amount of resistance in a given anaerobic exercise. Unfortunately, even if present, these sorts of electronic anaerobic monitoring apparatus are not accurate in measuring the number of repetitions performed in a given anaerobic exercise, or the number of sets performed in a given anaerobic exercise. Typically, such exercise devices may inaccurately detect multiple repetitions when a single repetition has been conducted. Alternatively, such devices may not count a repetition even where a repetition has been performed. Since accurate measurements of this sort of data can be important to a workout program, users typically rely on recording personal anaerobic exercise data on their own.

Accordingly, an advantage in the art can be realized with systems, methods, and apparatus that can accurately measure the number of repetitions a user performs through a wide variety of anaerobic motions. In particular, an advantage can be realized with monitoring apparatus that can accurately measure and display the number of repetitions a user performs, regardless of whether the repetitions are long, short, consistent, or inconsistent exercise motions.

BRIEF SUMMARY OF THE INVENTION

The present invention relates to a repetition sensor for use with an exercise device. In particular, the repetition sensor is sufficiently sensitive to accurately monitor short and/or inconsistent user repetitions, as well as detect long and/or consistent user repetitions. Furthermore, the repetition sensor can detect the speed and/or distance of the user's exercise movement.

According to one embodiment of the present invention, the repetition sensor includes an electricity generator, such as an electricity generator, which is utilized to generate an electrical signal in response to exercise motion of the exercise device. The repetition sensor is coupled to a moving component of the exercise device allowing the repetition sensor to monitor movement of the moving component. In one embodiment, the moving component moves in proportion to the user's exercise motion. Movement of the moving component results in electricity being generated by the electricity generator of the repetition sensor. In one embodiment, movement of the moving component results in movement of one or a plurality of magnetic components. Movement of the magnetic components causes movement of a portion of the generator facilitating voltage generation in the repetition sensor. In another embodiment, movement of the moving component results in movement of a ribbon, zip line, exercise cable, gear or other mechanism. Movement of the ribbon, zip line, exercise cable, gear or other mechanism causes movement of a portion of the generator facilitating voltage generation in the repetition sensor.

In one embodiment of the present invention, the electricity generator can provide differential electronic signals based on movement of the moving component. For example, the electricity generator can provide a positive electronic signal out of one wire when the moving component moves in a first direction, and a positive electronic signal out of another wire when the moving component moves in a second direction. This allows the repetition sensor to monitor positive and negative stroke movements of the exercise device by differentiating between which wire is sending (or receiving, in a completed circuit) the electrical signal generated by the electricity generator. As a result, even small changes in the directional movement of the moving component can be detected to accurately detect repetitions.

Software modules or electronic circuitry can then detect the different directions, amounts, and intensities of electronic signals, interpret the signals in combination with other data, and provide the user with an accurate depiction of exercise repetitions, exercise sets, distance of an exercise motion, speed or intensity of an exercise motion, and so on. In one embodiment, the software modules provide the user with a hypothetical depiction of distance and timing for a given exercise motion, and speed of the exercise motion for a given amount of weight. The actual data can then be compared with the hypothetical data to provide a user with pacing information throughout the exercise motion, such as 10% of stroke length at point A, 50% of stroke length at point B, etc.

In another embodiment, the software modules and electronic circuitry can be used to eliminate potential inaccuracies in the monitoring of sets and repetitions. For example, where a user is undertaking an exercise with long stroke lengths, smaller and inadvertent changes in directional movement can be disregarded as non-repetitions. Where a user is undertaking an exercise with smaller stroke lengths, even small changes in directional movement will be counted as intended repetitions. In one embodiment, the type and amount of movement can be tied to information regarding the type of exercise being performed. For example, where the electronic monitoring information detects that the user is conducting the pectoral fly exercise, small changes in directional movement will automatically be discounted. Where electronic monitoring information detects that the user is conducting a smaller stroke exercise such as calf lifts or forearm curls, small changes in directional movement will be counted as repetitions.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
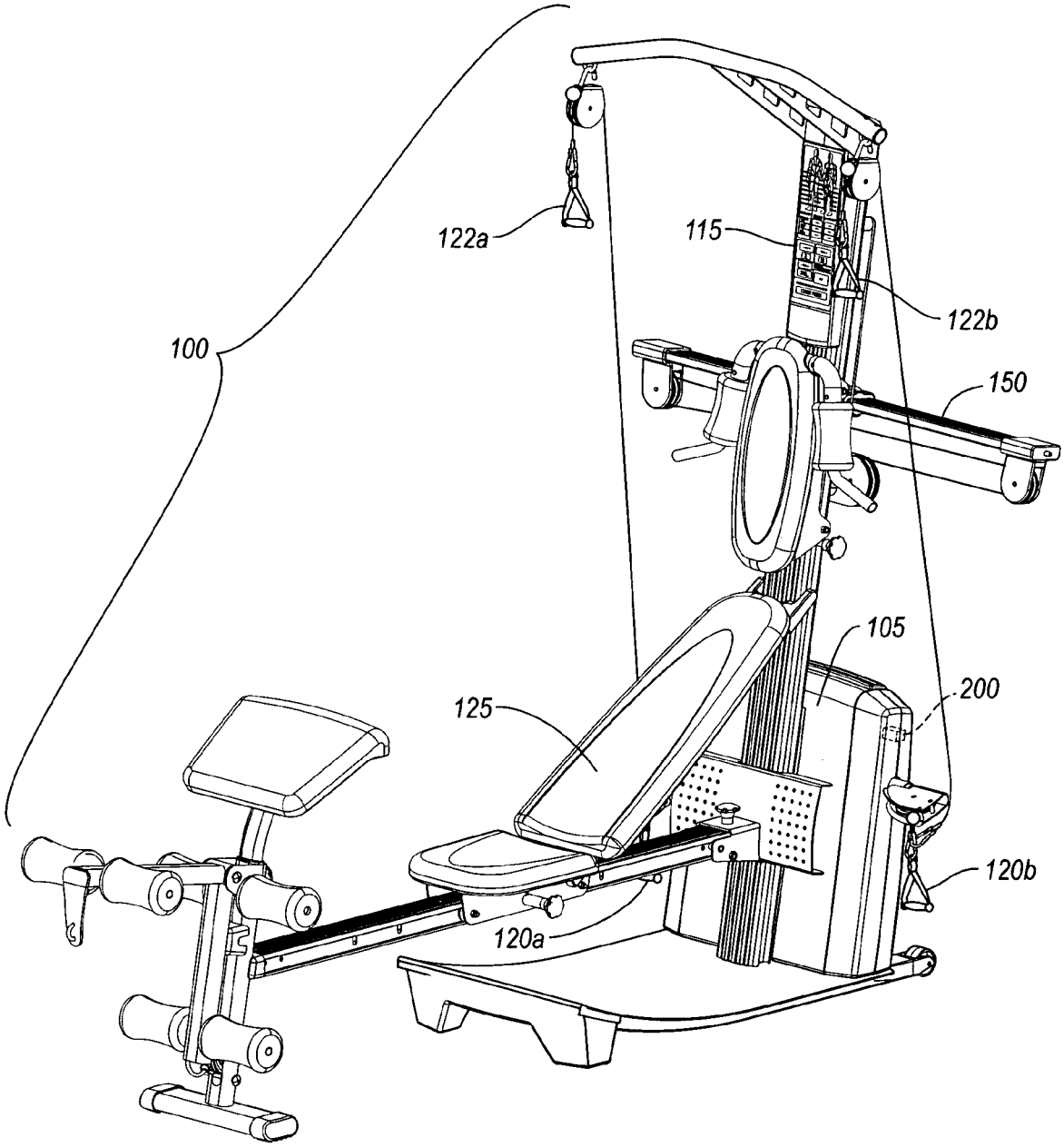
FIG. 1A illustrates a perspective view of an exercise device having a repetition sensor according to one embodiment of the present invention.

The present invention relates to a repetition sensor for use with an exercise device. In particular, the repetition sensor is sufficiently sensitive to accurately monitor short and/or inconsistent user repetitions, as well as detect long and/or consistent user repetitions. Furthermore, the repetition sensor can detect the speed and/or distance of the user's exercise movement.

According to one embodiment of the present invention, the repetition sensor includes (i) a frame; (ii) an electricity generator (e.g., an electricity generator) coupled to the frame; and (iii), a coupling portion (e.g., a ribbon, exercise cable, or a direct contact) for coupling the electricity generator to a moving component of the frame, wherein the electricity generator provides electricity (also referred to herein as an "electronic signal") in response to exercise motion of the exercise device. The repetition sensor is coupled to a moving component of the exercise device allowing the repetition sensor to monitor movement of the moving component. In one embodiment, the moving component moves in proportion to the user's exercise motion. Movement of the moving component results in generation of electricity by the electricity generator (also referred to herein as a "electricity generator") of the repetition sensor. In one embodiment, movement of the moving component results in movement of one or a plurality of magnetic components. Movement of the magnetic components causes movement of a portion of the generator facilitating voltage generation in the repetition sensor. In another embodiment, movement of the moving component results in movement of a linkage (e.g., ribbon, string, wire, zip line, exercise cable, gear or other mechanism). Movement of the linkage causes movement of a portion of the generator facilitating voltage generation in the repetition sensor.

In one embodiment of the present invention, the electricity generator can provide differential electronic signals based on movement of the moving component. For example, the electricity generator can provide a positive electronic signal out of a first wire when the moving component moves in a first direction, and a positive electronic signal out of a second wire when the moving component moves in a second direction. This allows the repetition sensor to monitor positive and negative stroke movements of the exercise device by differentiating between which wire is sending the electronic signal (or which wire is receiving the electronic signal in a completed circuit). As a result, even small changes in the directional movement of the moving component can be monitored to accurately identify repetitions. Software modules or electronic circuitry can then detect the different directions of electronic signals, interpret the signals in combination with other data, and provide the user with an accurate depiction of exercise repetitions, exercise sets, and so on.

In another embodiment, the software modules and electronic circuitry can be used to eliminate potential inaccuracies in the monitoring of sets and repetitions. For example, where a user is undertaking an exercise with long stroke lengths, smaller and inadvertent changes in directional movement can be disregarded as non-repetitions. Where a user is undertaking an exercise with smaller stroke lengths, even small changes in directional movement will be counted as intended repetitions. In one embodiment, the type and amount of movement can be tied to information regarding the type of exercise being performed. For example, where the electronic monitoring information detects that the user is conducting a pectoral fly exercise, small changes in directional movement will automatically be discounted. Where electronic monitoring information detects that the user is conducting a smaller stroke exercise such as calf lifts or forearm curls, small changes in directional movement will be counted as repetitions.

FIG. 1A illustrates an exercise device 100 having a repetition sensor 200 for monitoring repetition movement during exercise. Repetition sensor 200 is configured to accurately identify the occurrence and number of repetitions that are conducted. Repetition sensor 200 provides fine tuned monitoring of the exercise movement to allow intelligent monitoring of repetitions during exercise. This can help minimize non-repetitions that are counted as repetitions and repetitions that are not counted as repetitions to provide a more accurate assessment of the number of repetitions performed.

In the illustrated embodiment, a user performs an exercise repetition by pulling one or more of gripping handles 120*a*, 120*b*, 122*a*, and 122*b* in one direction (e.g., downward), and then releasing the gripping handles back in a reverse direction (e.g., upward). The user can position him/herself on or adjacent to exercise bench 125 depending on the exercise routine being performed. When a repetition is performed, repetition sensor 200 identifies whether a repetition has occurred. Repetition sensor 200 interfaces with an electronic display 115 to identify and display the number of exercise repetitions (or the number of repetitions and/or sets) that have been completed by the user.

Repetition sensor 200 is coupled to exercise system 100 so as to monitor the number of exercise repetitions performed. In the illustrated embodiment, repetition sensor 200 is included in a resistance assembly 105. Resistance assembly 105 utilizes a resistance component 150 to provide resistance that is utilized during exercise. In the illustrated embodiment, the resistance component 150 comprises a resilient elongate rod which flexes to provide the resistance to be utilized during exercise. One will appreciate that a variety of types and configurations of resistance components can be utilized without departing from the scope and spirit of the present invention. For example, in one embodiment the resistance component comprises a resilient band. In another embodiment, the resistance component comprises a weight stack. In another embodiment, the resistance component comprises one or a plurality of springs. In another embodiment, the resistance component comprises a member or mechanism that provides a predetermined resistive force to be utilized during exercise.

A user utilizes one or more of gripping handles 120*a*, 120*b*, 122*a*, and 122*b* to perform exercise. When the user pulls one or more of gripping handles 120*a*, 120*b*, 122*a*, and 122*b* in a positive stroke direction, resistance component 150 flexes or is otherwise actuated. When the user releases the gripping handle(s) being utilized (of gripping handles 120*a*, 120*b*, 122*a*, and 122*b*) in a negative stroke direction, resistance component 150 relaxes.

In a typical exercise routine, a positive and negative stroke combination comprises a single repetition. A defined number of repetitions comprise a set. Various numbers and combinations of sets and repetitions can be utilized to achieve different types of desired results. For example, an intermediate number of repetitions (e.g. 6-10) and an intermediate number of sets (e.g. 3-4) are often utilized to enhance the strength and size of muscles during strength training routines. A larger number of repetitions (12-20) and a smaller number of sets (e.g. 1-2) are used for muscle toning routines. As will be appreciated by those skilled in the art, any number of sets and repetitions can be utilized without departing from the scope and spirit of the present invention. The repetition counter is adapted to help a user monitor the number of repetitions and/or sets that are performed during a given exercise routine.

A variety of types and configurations of resistance components and anaerobic resistance systems can be utilized without departing from the scope and spirit of the present invention. For example, in one embodiment, a weight stack is utilized. In another embodiment, one or more adjustable resistance members and/or systems are utilized. In yet another embodiment, the resistance component and anaerobic resistance system are separate components. In another embodiment, the resistance system comprises an aerobic resistance system. In yet another embodiment, a resistance system that allows a user to perform repetitions for aerobic and/or anaerobic benefit is utilized.

Figure 1B:
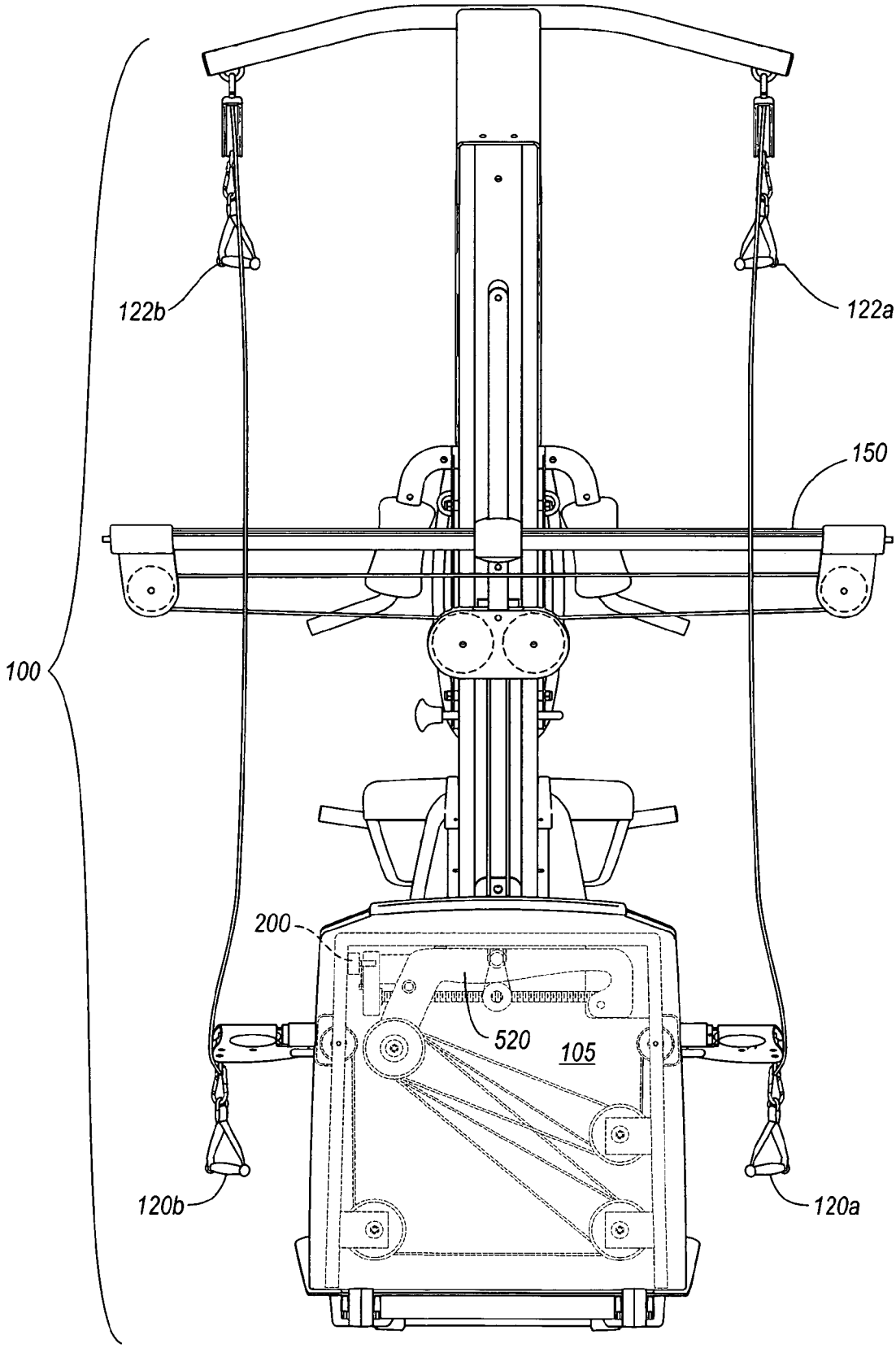
FIG. 1B illustrates a rear view of the exercise device depicted in FIG. 1A.
Figure 5:
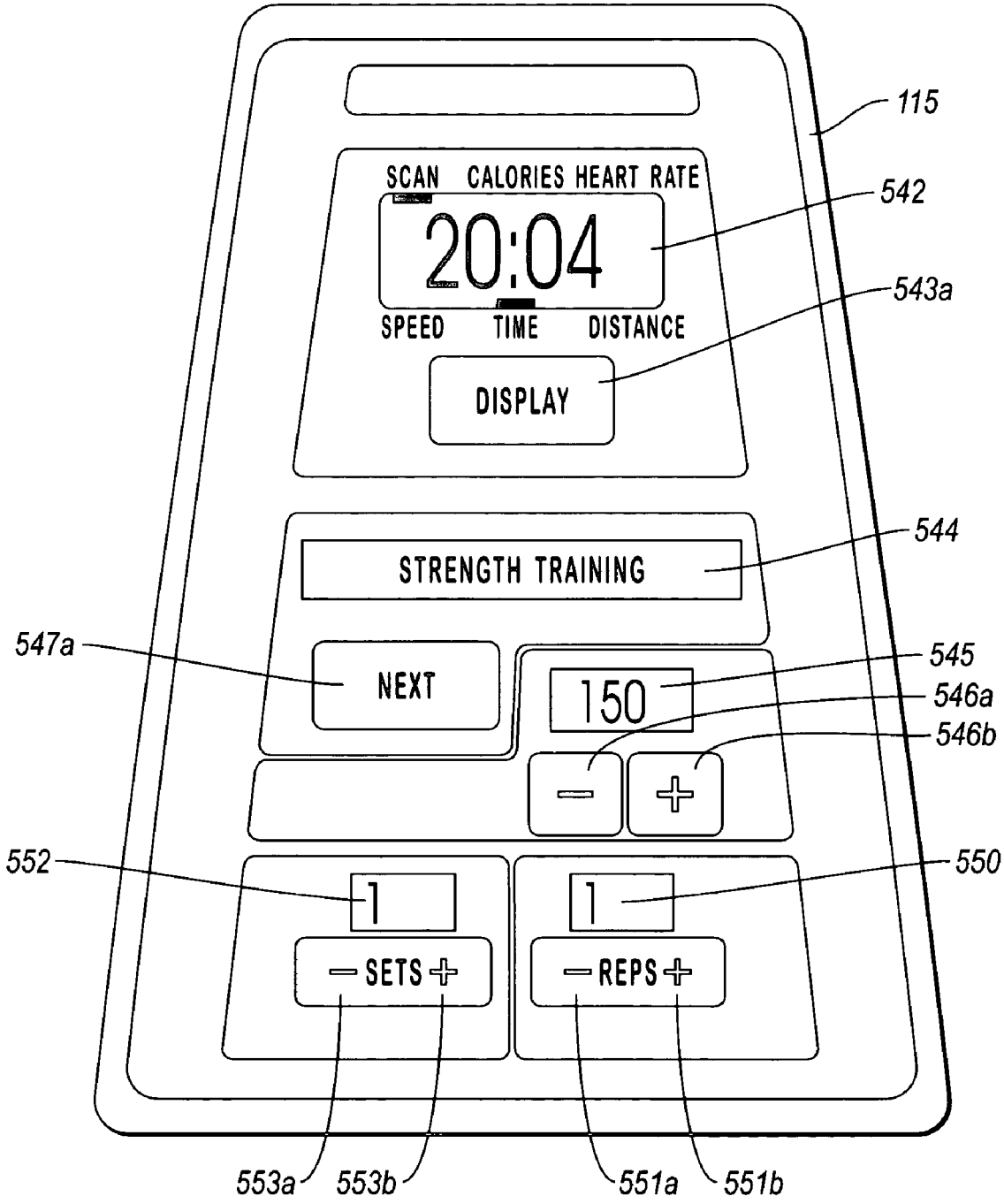
FIG. 5 illustrates an exemplary console for displaying repetition related information received from a repetition sensor in accordance with one embodiment of the present invention.

FIG. 1B illustrates repetition sensor 200 coupled directly to a lever arm 520 of resistance assembly 105 (see also FIG. 5). In the illustrated embodiment, lever arm 520 comprises a moving component of exercise device 100. Movement of lever arm 520 corresponds with actuation of the resistance component 150 and stroke movements of one or more of gripping handles 120*a*, 120*b*, 122*a*, and 122*b*. As a result, when a user undertakes an exercise repetition, movement of gripping handles 120*a*, 120*b*, 122*a*, and 122*b* moves lever arm 520. Because repetition sensor 200 is linked to lever arm any movement of gripping handles 120*a*, 120*b*, 122*a*, and 122*b* is monitored by repetition sensor 200.

A variety of types and configurations for monitoring repetitions can be utilized without departing from the scope and spirit of the present invention. For example, the repetition sensor can be linked to any moveable component of the resistance assembly or resistance component. In one embodiment, one or more repetition sensors can be utilized in connection with the one or more gripping handles, one or more pulleys of the resistance assembly, or one or more movable cables, one or more resilient bands or springs, one or more weights in a weight stack, one or more shocks, and so forth. Alternatively, the repetition sensor may be coupled to a moving part that extends away from the exercise system, but nevertheless moves in response to an exercise force. In one embodiment, the repetition sensor is positioned and/or coupled such that it generates an electrical signal in response to a user-applied exercise force.

Figure 2A:
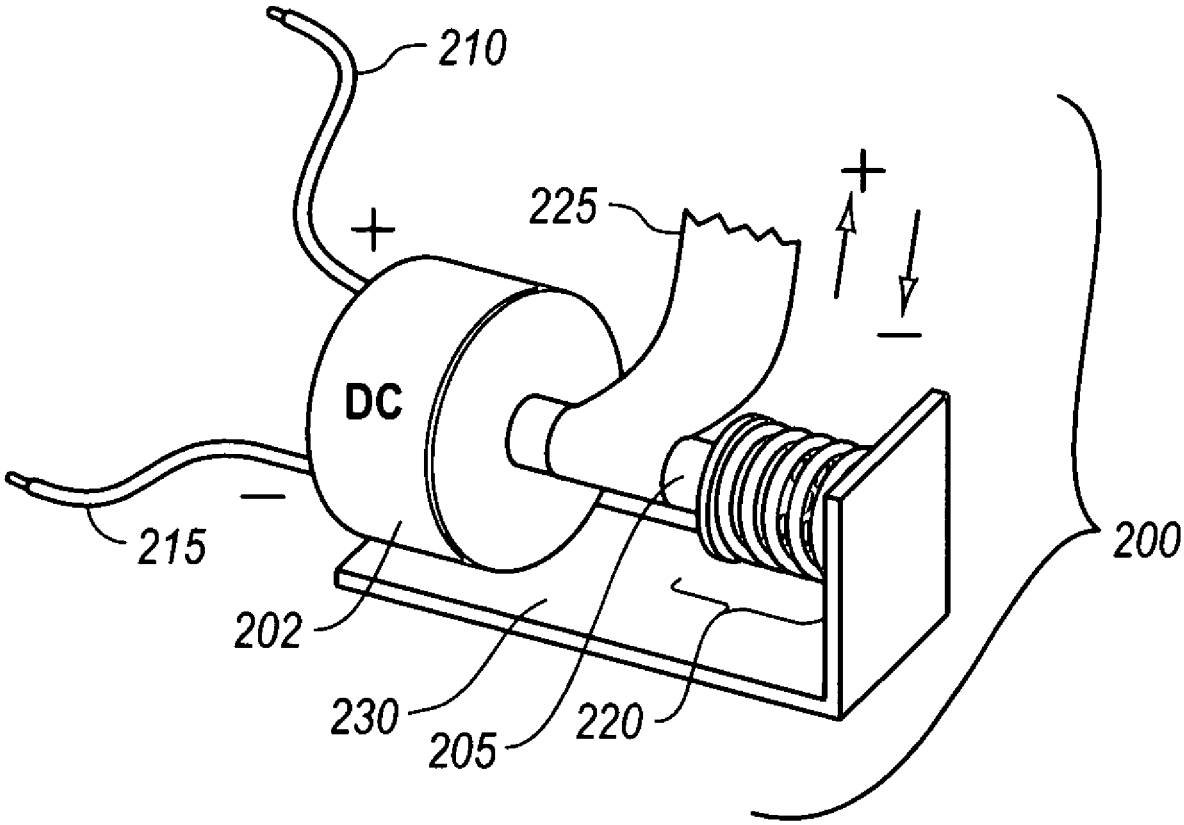
FIG. 2A illustrates a perspective view of a repetition sensor having an electricity generator, a ribbon, and a rewind spring that can be used with the exercise device of FIG. 1A.

FIG. 2A illustrates repetition sensor 200 in greater detail according to one embodiment of the present invention. In the illustrated embodiment, repetition sensor 200 comprises an electricity generator 202, a torque spindle 205 coupled to generator 202, circuit wires 210 and 215 extending from generator 202, rewind spring 220 coupled to spindle 205, ribbon 225 wound about torque spindle 205, and sensor frame 230. Electricity generator 202 generates electrical signals in response to a user applied exercise force. In the illustrated embodiment, the electrical signals are generated during movement of an exercise repetition. Electricity generator 202 is one example of a means for generating a signal representing repetition movement of the resistance assembly. In another embodiment, the means for generating a signal comprises a magnetic signal generator.

A variety of types and configurations of electricity generators can be utilized without departing from the scope and spirit of the present invention. For example, in one embodiment, the electricity generator comprises a generator motor. In another embodiment, the electricity generator comprises a magnet-based electricity generator which generates an electrical signal in response to a mechanical stimulus. In one embodiment, the electricity generator can include a current generator, a voltage generator, or any generator that converts a mechanical stimulus into a signal indicative or repetition movement. For example, the electricity generator can utilize a radio frequency (RF) signal or other digital or analog signal to convey repetition movement related information.

In the illustrated embodiment, ribbon 225 comprises a retractable pulling member that has been wound about torque spindle 205 in connection with rewind spring 220. In this embodiment, a manufacturer can couple ribbon 225 to a moving apparatus, such as one or more movable members of resistance assembly 105 (see e.g. lever arm 520 of FIGS. 2B-2C) that move in response to repetition movements. Ribbon 225 can also be replaced in other embodiments with string, twine, wire, or other types of pulling members. Ribbon 225 is one example of a linkage and/or a repetition movement member. The electricity generator 202 of repetition sensor 200 is coupled to exercise system frame 100 (see FIG. 1A) utilizing sensor frame 230, such that when the movable member of the exercise device is moved during an exercise repetition, ribbon 225 is extended. Typically, sensor frame 230 is coupled to a fixed member of exercise system frame 100 at an angle relative to the movable component which optimizes the unwinding and rewinding of ribbon 225 when the movable component moves during exercise. In the illustrated embodiment, sensor frame 230 is coupled to a frame component adjacent resistance assembly 105. Rewind spring 220 facilitates retraction of ribbon 225 during the negative stroke movement experienced during the course of a repetition.

Because ribbon 225 is coupled to a movable member of the exercise system that moves in connection with repetition movements, extension and retraction of ribbon 225 corresponds with repetition movements occurring during exercise. In particular, torque spindle 205 is configured to move in correspondence with extension and retraction of ribbon 225. Torque spindle 205 conveys the mechanical stimulus corresponding to the repetition movements experienced during exercise from ribbon 225 to generator 202. Generator 202 translates the rotational movement of torque spindle 205 into an electrical signal that represents the repetition movements. Circuit wires 210 and 215 deliver the corresponding electrical signal to another component, such as electronic console 115 (see, e.g., FIG. 1A).

The configuration of repetition sensor 200 allows even small and/or incremental directional changes of repetition movement experienced during an exercise routine to be detected. This facilitates monitoring of both long and smaller stroke repetitions. For example, during a wrist curl or other smaller stroke exercises, even small movements in both the positive and negative stroke direction can be detected. The exercise device can include a logic module to ensure proper monitoring of the number and occurrence of exercise repetitions. For example, where the logic module detects longer stroke lengths during an exercise set, small changes in directional movement can be disregarded as non-repetitions. In contrast, where the logic module detects multiple directional movements of small stroke length, each of the directional movements can be counted as a repetition. A more detailed description of logic modules will be described with reference to FIG. 5.

Thus, for example, when a user undertakes an exercise repetition, ribbon 225 unwinds from repetition sensor 200 causing spindle 205 to rotate in a first direction. This causes electricity (i.e., voltage in the form of a direct current) to flow in a direction from circuit wire 210 and ultimately back through circuit wire 215 (i.e., positive from circuit wire 210 to circuit wire 215, as depicted). By contrast, when the user releases the force on exercise system 100, rewind spring 220 retracts ribbon 225 back onto itself causing spindle 205 to rotate in the opposite direction as when ribbon 225 is extended. Thus, the direction of electricity flows in an opposite direction from circuit wire 215 back through circuit wire 210, contrary to the + and – designations.

The repetition sensor 200 illustrated in FIG. 2A can comprise any direct current (DC) or alternating current (AC) generator, although the present description will be directed primarily toward DC generators, for purposes of convenience. With respect to DC, for example, circuit wires 210 and 215 represent a difference in electronic energy potential, which corresponds to the direction of movement for torque spindle 205. As illustrated, if spindle 205 spins in a clockwise direction, the electricity generator sends out an electrical signal from circuit wire 210 (+) toward circuit wire 215 (–) due to the lower electronic energy potential of circuit wire 215. If spindle 205 spins in a counterclockwise direction, the electrical energy potential for the two circuit wires is reversed, such that the electricity generator sends out an electrical signal from circuit wire 215 back toward circuit wire 210. These directions of electronic signal travel ("+" or "–") relative to the spin of the torque spindle 205, however, are arbitrary, and depend at least in part on the configuration of electricity generator 202 as it is manufactured. The electricity generator can also send out differing amounts and/or intensities of electricity based on the number of times the torque spindle 205 has rotated, and the speed at which the torque spindle 205 rotates.

With respect to an AC generator, there is little meaningful difference in energy potential between the two circuit wires 210 and 215. Rather, an AC generator 200 sends out an electronic signal between the two wires with varying amplitude, which corresponds to the speed of movement for torque spindle 205. For example, as the user initiates an exercise, such as by beginning to move gripping handles (e.g., 120*a* and 120*b*) in one direction, the initial speed of torque spindle 205 is small. As the user progresses through a full exercise motion, torque spindle 205 speed increases, and then diminishes toward the end at full extension. A similar change in torque spindle 205 speed occurs when the user returns the gripping handles (e.g. 120*a* and 120*b*) to a relaxed position. Similarly, where there is change in direction, such as where the user moves from a positive stroke direction to a negative stroke direction, the speed decreases, effectively stops and slowly increases.

Accordingly, if the electronic console 115 (see FIG. 1A) is coupled to a DC generator, electronic console 115 identifies an exercise repetition by detecting the direction and/or intensity of electrical flow, or the difference in electronic potential energy on the two circuit wires 210 and 215. In particular, electronic console 115 is configured for a first response when electricity travels from circuit wire 210 (positive, +) around to circuit wire 215 (negative, –), and for a second response when the electricity travels from circuit wire 215 (positive, +) to circuit wire 210 (negative, –). By contrast, if electronic console 115 is coupled to an AC generator, electronic console 115 would identify an exercise repetition by identifying a minimum or maximum AC amplitude that cycles between circuit wires 210 and 215. In either case, the electronic console can also identify the distance and/or speed of the exercise repetition based on the detected number and/or speed of torque spindle 205 revolutions. Accordingly, the electricity generator may comprise a conventional speedometer or odometer.

Figure 2B:
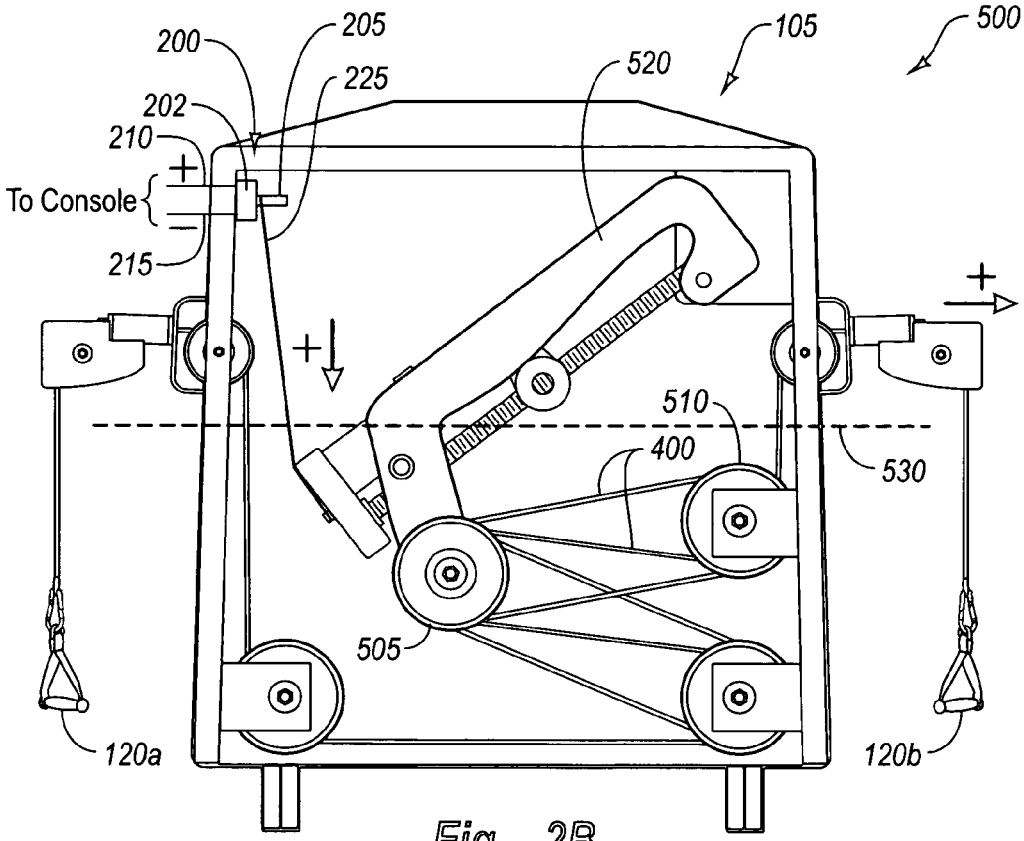
FIG. 2B illustrates the repetition sensor of FIG. 2A utilized with a lever arm of a resistance assembly in an actuated position according to one embodiment of the present invention.
Figure 2C:
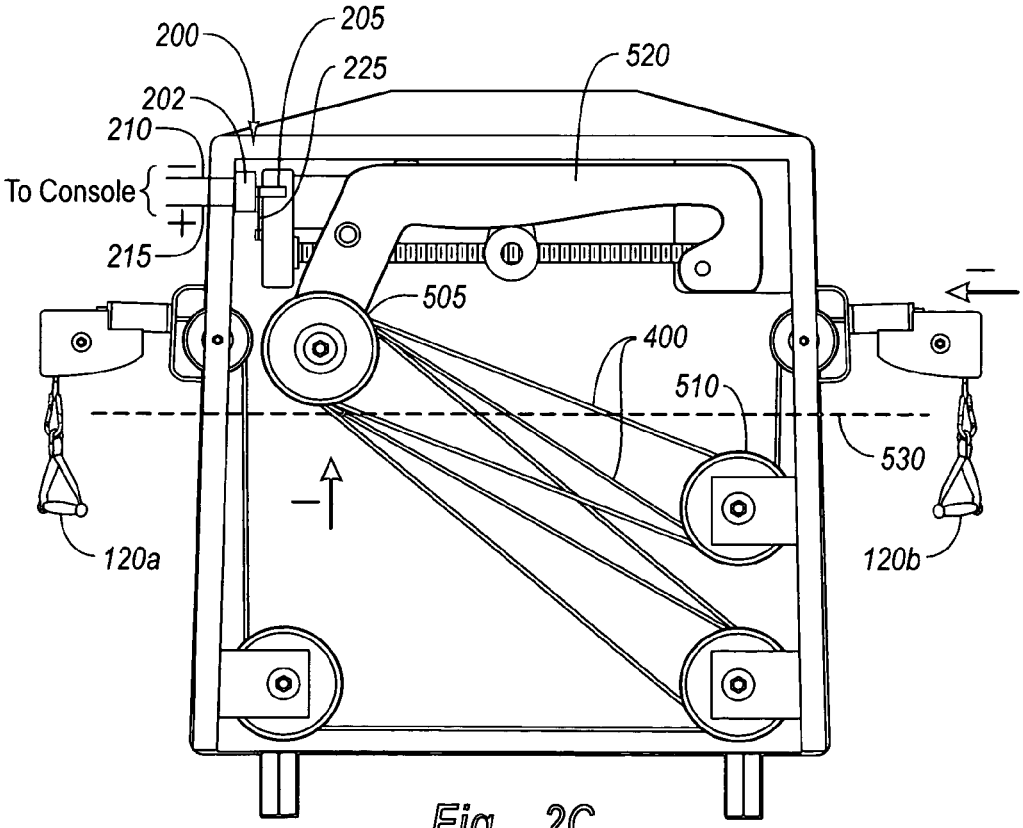
FIG. 2C illustrates the repetition sensor of FIG. 2A with a lever arm of the resistance assembly depicted in a resting position according to one embodiment of the present invention.

FIGS. 2B and 2C illustrate operation of repetition sensor 200 in connection with operation of resistance assembly 105 and movement of a lever arm 520 from a first point, illustrated in FIG. 2B, to a second point illustrated in FIG. 2C. In particular, FIGS. 2B and 2C show a variable resistance system 500 of resistance assembly 105 than can comprise a series of pulleys 505 and 510, which are operably connected to each other through a cable 400. When a repetition is performed, force is exerted on one or both ends of cable 400 resulting in movement of a lever arm 520. Exemplary mechanisms for implementing a cable and pulley-based variable resistance system 500 are described in commonly-assigned U.S. Pat. No. 6,685,607, entitled "Exercise Device with Resistance Mechanism Having a Pivoting Arm and a Resistance Member". Additional exemplary mechanisms for implementing a repetition sensor in an exercise system are also described in a commonly-assigned U.S. patent application Ser. No. 10/916, 684 of Dalebout, et al., filed on Aug. 11, 2004 via U.S. Express Mail Number EV 432 689 375 US, entitled "ELLIPTICAL EXERCISE MACHINE WITH INTEGRATED ANAEROBIC EXERCISE SYSTEM," the entire contents of which are incorporated herein by reference.

As shown in FIG. 2B, gripping handles 120*a* and 120*b* are drawn away from variable resistance system 500 (e.g., via a user's exercise motion), causing lever arm 520 to extend below a point defined by a horizontal plane 530. In this position, ribbon 225 is extended from the other components of repetition sensor 200 in proportion to the amount of extension of gripping handles 120*a* and 120*b*. Extension of ribbon 225 results in rotation of spindle 205 in a given direction and/or speed. The rotation of torque spindle 205 causes electricity generator 202 to send a positive electrical signal from circuit wire 210 (+) around to circuit wire 215 (–).

As shown in FIG. 2C, when the user releases the force on the gripping handles 120*a* and 120*b* (e.g., handles 120*a* and 120*b* retract upward), cable 400 and pulleys 505, 510 relax, allowing lever arm 520 to also retract to a relaxed position. (The comparatively relaxed position for lever arm 520, in this case, is above a horizontal plane 530, in contrast with FIG. 2B.) Furthermore, this causes ribbon 225 to retract as rewind spring 220 (see FIG. 2A) relaxes. As rewind spring 220 relaxes and ribbon 225 retracts, rewind spring 220 rotates spindle 205 in the opposite direction that spindle 205 moves when ribbon 225 is extended as shown in FIG. 2B. Accordingly, repetition sensor 200 generates a positive electrical signal that travels in a direction opposite to the direction of the electrical signal in FIG. 2A, or from the circuit wire 215 (+) to circuit wire 210 (–).

Figure 3A:
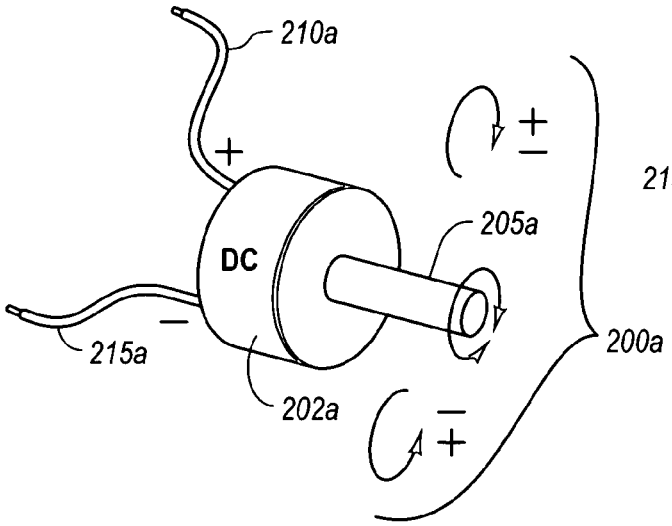
FIG. 3A illustrates a repetition sensor having a torque spindle which is actuated by a mechanism other than a ribbon and/or a rewind spring according to one embodiment of the present invention.

FIG. 3A illustrates an alternative embodiment of repetition sensor 200*a* in which torque spindle 205*a* is rotated utilizing a mechanism other than ribbon 225 and rewind spring 220 of FIG. 2A. In the illustrated embodiment, torque spindle 205*a* is configured to rotate in both a clockwise and counterclockwise direction. When torque spindle 205*a* is rotated in a first direction, electricity generator 202*a* generates a positive electronic signal through a first circuit wire 210*a*, such that wire 215*a* is negative. When torque spindle 205*a* is rotated in a second direction, electricity generator 202*a* generates a positive electronic signal out of second wire 215*a*, such that wire 210*a* is negative (reverse depiction of FIG. 3A). When the exercise system detects a positive voltage signal out of a given first or second wire 210*a* and 215*a*, the exercise system can determine that a positive stroke and negative stroke have occurred culminating in a completed exercise repetition.

In the illustrated embodiment, torque spindle 205*a* is configured to be rotated by a mechanism other than ribbon 225 and rewind spring 220 of FIG. 2A. As will be appreciated by those skilled in the art, a variety of types and configurations of mechanisms can be utilized without departing from the scope and spirit of the present invention. For example, in one embodiment, torque spindle 205*a* is driven by magnetic forces which provide rotational movement of spindle 205*a*.

Movement of the moving component corresponds with movement of magnets or otherwise the creation of variably magnetic forces to cause rotational movement of spindle 205*a*. In the embodiment illustrated in FIGS. 3B and 3C, the spindle is rotated by contact with a pulley. In the embodiment illustrated in FIGS. 4A and 4B, the spindle is rotated by a zip line connected to the movable member.

Figure 3B:
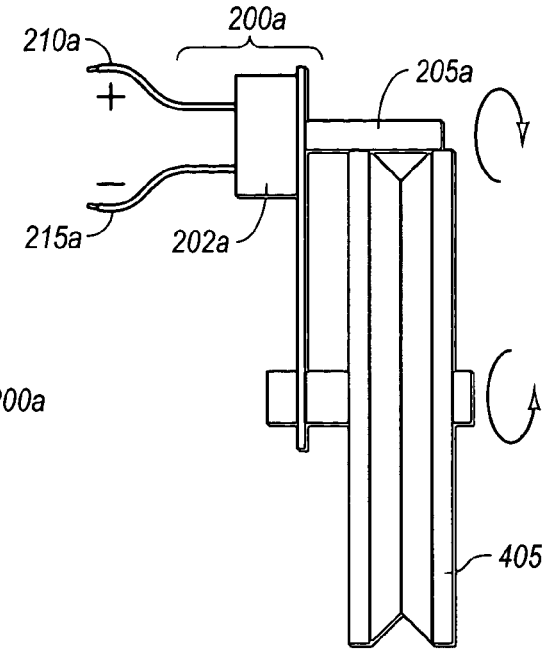
FIG. 3B illustrates a front view of the repetition sensor of FIG. 3A being actuated by a pulley according to one embodiment of the present invention.
Figure 3C:
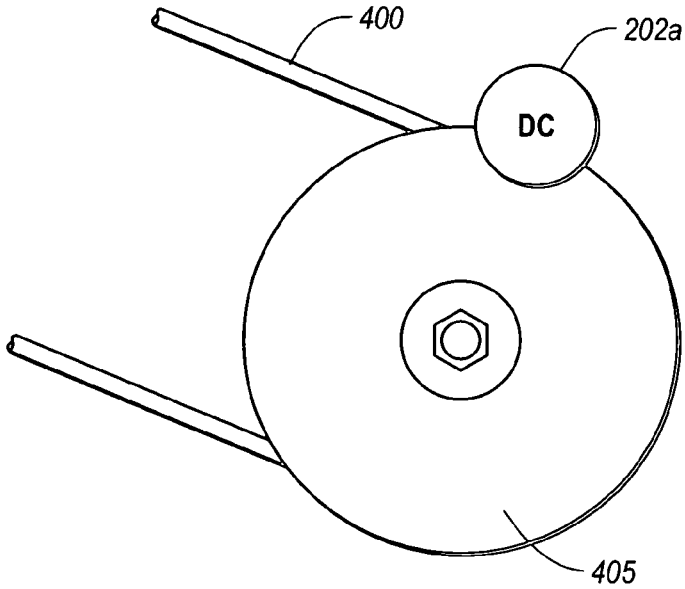
FIG. 3C illustrates a side view of the repetition sensor depicted in FIG. 3B illustrating the positioning of the repetition sensor relative to the pulley according to one embodiment of the present invention.

FIGS. 3B and 3C illustrate respective side and back views of a yet another embodiment of the repetition sensor 200*a* of FIG. 3A, in which repetition sensor 200*a* is configured to be utilized with a pulley 405 providing the force necessary to cause rotational movement of torque spindle 205*a*. In particular, FIG. 3B shows that spindle 205*a* is aligned with a perimeter surface of a pulley 405, such that spindle 205*a* rotates with pulley 405. Thus, for example, when a user exerts a force on one or more of gripping handles (e.g., 120*a*, 120*b*), one or more corresponding cables 400, which are further coupled to one or more pulleys, move in response to the movement of the one or more gripping handles.

In the illustrated embodiment, when the corresponding cable 400 is moved during an exercise repetition, at least one of the one or more pulleys (e.g., 405) rotates in connection with cable 400. Rotation of pulley 405 causes rotation of spindle 205*a*, which abuts the rotating pulley 405, in an opposite direction as the rotation of pulley 405. When spindle 205*a* rotates, a corresponding positive electrical signal is created from within electricity generator body 202*a*, which in turn flows out of either circuit wire 210*a* or 215*a*. In other words, an electrical signal can be sent by electricity generator 202*a* out of one of two wires depending on the rotational direction of spindle 205*a*. The wire (210*a* or 215*a*) in which the current travels in a positive direction depends on how the electricity generator of the repetition sensor 200*a* is configured, and depends on the direction of the spindle 205*a* rotation.

Figure 4A:
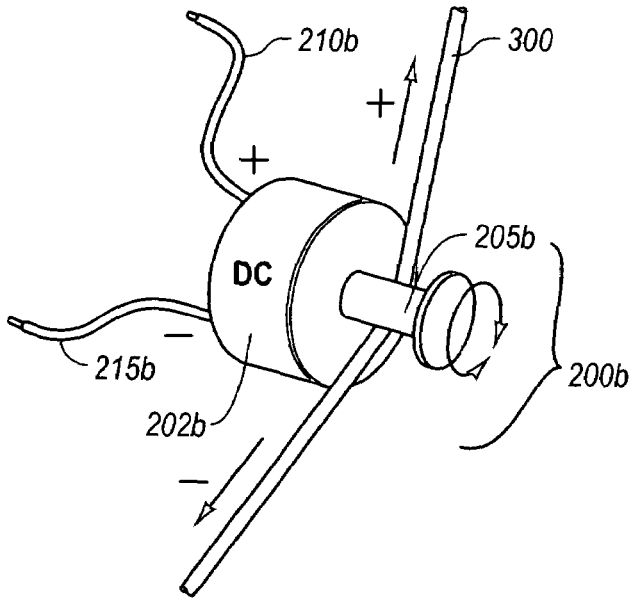
FIG. 4A illustrates a close up side view of a repetition sensor for use with a zip line according to one embodiment of the present invention.

FIG. 4A illustrates an embodiment of repetition sensor 200*b* in which repetition sensor 200*b* is configured to roll about a zip line 300. In at least one embodiment, electricity generator 202*b* of repetition sensor 200*b* may be secured to a frame of the exercise system 100, while spindle 205*b* is pressed against the zip line 300 using frictional forces. In another embodiment, the spindle 205*b* and zip line 300 can comprise a series of corresponding ridges and grooves (not shown), or other tactile features, formed thereon, which cause the spindle more securely with the movement of the zip line 300. In short, there are a variety of means for coupling spindle 205*b* such that it rotates about a moving resistance component. Thus, when zip line 300 moves with a user's exercise movement, spindle 205*b* rotates with the zip line 300.

Figure 4B:
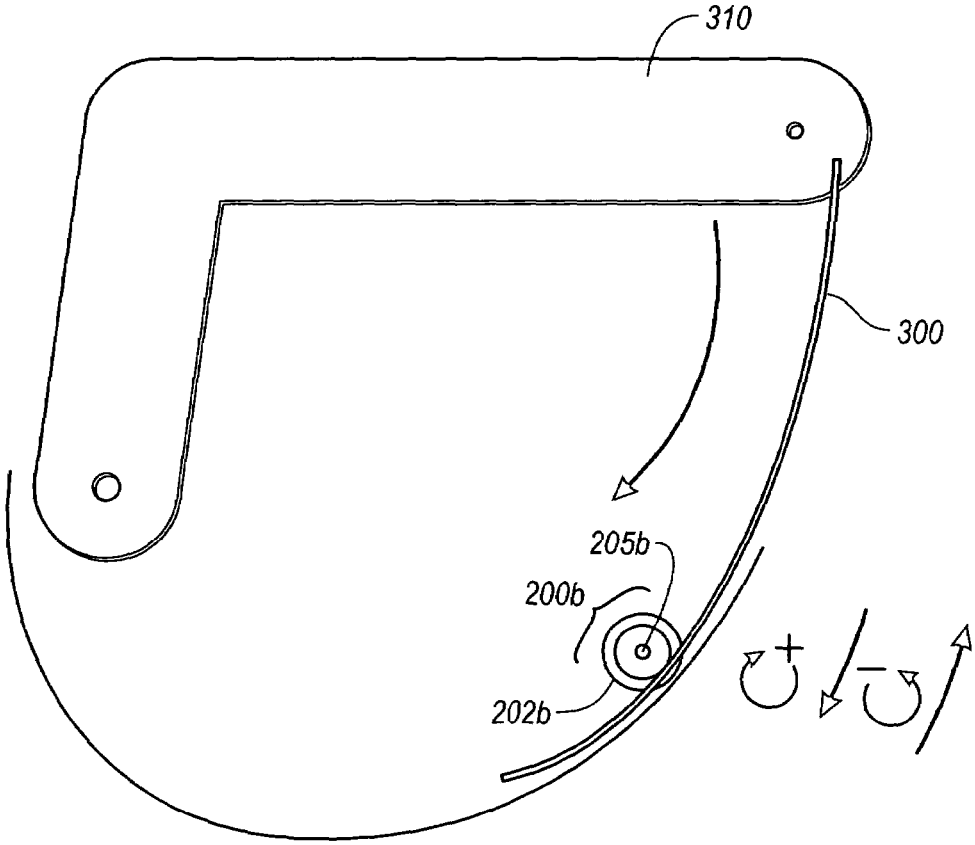
FIG. 4B illustrates an overview of the repetition sensor depicted in FIG. 4A relative to a lever arm according to one embodiment of the present invention.

FIG. 4B illustrates a more particular example of how the resistance member and associated apparatus described in FIG. 4A can operate. As illustrated, a lever arm 310 rotates with an applied force, causing the attached zip line 300 (e.g., an exercise cable) to move in one direction. When zip line 300 moves with resistance arm 310, spindle 205*b* of repetition sensor 200*b* rotates with the moving zip line 300. When the user releases the force, zip line 300 moves backward with resistance arm 310, such that spindle 205*b* rotates with the zip line 300 in the reverse direction. As previously described, this causes the electricity generator to send a corresponding positive electrical signal through either circuit wire 210*b* or circuit wire 215*b* (see FIG. 4A), as appropriate. The description in FIGS. 4A-B can also apply to the situation in which torque spindle 205 is coupled to an exercise cable (e.g., zip line) that is present outside of a resistance assembly frame, such that repetition sensor 200 is closer to, for example, a given gripping handle.

FIG. 5 illustrates an electronic console 115 for illustrating the number of repetitions conducted during an exercise routine as monitored by a repetition sensor. In the illustrated embodiment, electronic console 115 detects the direction of electronic signals traveling from and/or to one of the circuit wires 210 and 215 connected to repetition sensor 200 (see FIG. 2A). In particular, computer-executable instructions stored in electronic console 115 or associated components can be configured to detect specific directions of electrical signals based on the configuration of the repetition sensor, and then determine if the user has made an exercise repetition. For example, the instructions can be configured so that only an instance of a positive electrical signal through a first circuit wire can trigger an exercise repetition. Thus, when a user places a force on the gripping handles in one outward motion, and then releases the handles backward in the opposite direction, repetition sensor relays signals to electronic console 115 which are interpreted as a single exercise repetition. As shown in FIG. 5, electronic console 115 can then display an indication of the number of repetitions that have been completed on a display repetition module 550.

Electronic console 115 can display (or input) a number of properties related both to repetitions and to resistance. For example, resistance display module 545 indicates the level of resistance that the user has selected via input buttons 546*a* and 546*b*. As discussed, console 115 can also include a display repetition module 550 that displays (or allows input via buttons 551*a* and 551*b*) the number of repetitions to a user. The console 115 can also comprise a set display module 552 that displays (or allows input via buttons 553*a* and 553*b*) the number of sets to a user. For example, the manufacturer can configure the computer-executable instructions to identify a delay of 30 seconds or more between consecutive exercise repetitions as a change in exercise sets. Hence, console 115 can also display to the user that the user is performing repetition 1 of exercise set 1, as well as repetition 2 of exercise set 3, and so forth.

One will also appreciate that a manufacturer can configure console 115 to display aerobic data in conjunction with the described anaerobic repetition data. For example, console 115 can include a display 542 that indicates a user's heart rate, weight, duration of workout, historical data related to both anaerobic data and aerobic data, and so forth. A button 543*a* can be used to scroll through each type of data. This type of data can also be combined with the data detected by repetition sensor 200 (see FIG. 2A) to more accurately display, for example, the number of calories a user has burned during both aerobic and anaerobic exercises. The electronic console can also include a display interface 544 that indicates the type of workout routine being performed, as well as a button 547*a* for selecting different workout routines.

One advantage of repetition sensor 200 of FIG. 2A is that current or electricity generators are generally sensitive enough to generate electricity based even on very small motions. Accordingly, a user can register the indication of an exercise repetition by performing any type of exercise motion in one direction, and having corresponding retraction in another direction. As such, one small and inconsistent wrist curl motion can trigger the same number of repetitions as one longer and potentially more consistent exercise motion such as conducted during a bench press or squat exercise routine.

Figure 6:
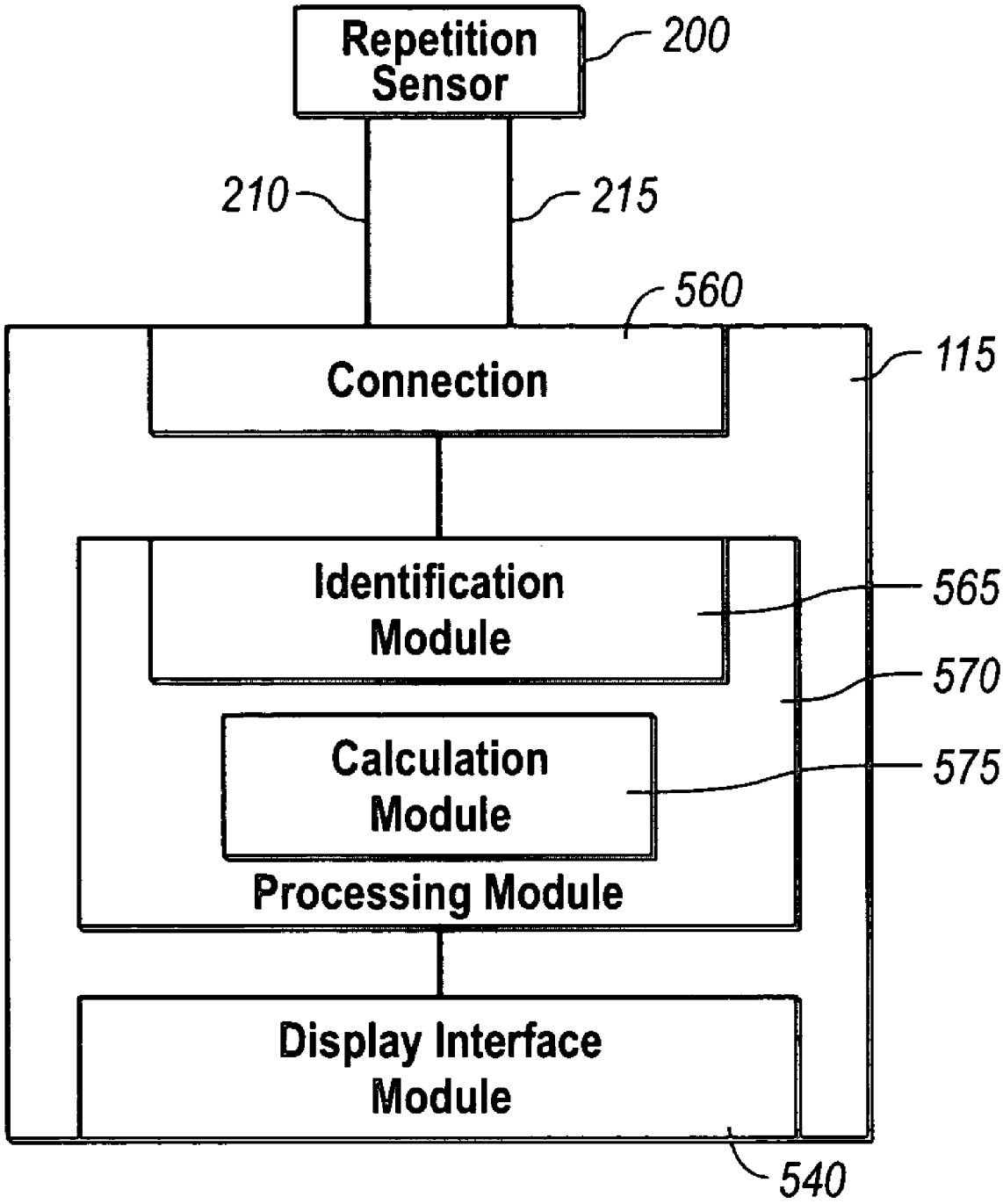
FIG. 6 is a block diagram illustrating a logic module having various modules and interfaces suitable for implementing electronic repetition data through an electronic console in accordance with one embodiment of the present invention.

FIG. 6 is a block diagram illustrating exemplary hardware and software components and interfaces that can be used with an exemplary electronic display console 115. In particular, FIG. 6 shows that electronic console 115 comprises an electrical connection interface 560, which electrically couples repetition sensor 200 to console 115 through at least circuit wires 210 and 215. The connection interface 560, in turn, is electrically coupled to a processing module 570.

Processing module 570 can include one or more hardware components such as a central processing unit (CPU), read-only memory (ROM), random access memory (RAM), other magnetic or optical storage, and any other necessary active or passive circuitry mounted on a printed circuit board (PCB). The storage components can be configured to further include computer-executable instructions. Thus, for example, an identification module 565 can comprise computer-executable instructions for identifying, or sensing, an electronic "signal property." The signal property can be the direction of electricity flowing between circuit wire 210 and circuit wire 215, or that some minimum amplitude of electricity that has passed between circuit wires 210 and 215. The signal property can also be a sensed voltage or current of the electricity.

The current identification module 570 can then pass the identified signal property to a calculation module 575. Calculation module 575, in turn, can identify any number of results-based data, and format the data to be sent through display interface module 540 to any of the corresponding display interfaces (e.g., display 542, 544, etc. of FIG. 5.) For example, calculation module 575 can determine that one or more exercise repetitions have been completed, or based on a comparison algorithm, can determine that a user has not yet completed a given repetition, but is in the middle of a single exercise repetition. Still further, calculation module 575 can be configured to compare present data with previously stored user data; as well as compare present data with data identifying the level of resistance in the current exercise.

Calculation module 575 can also determine a number of results-based information including duration of sets, calories burned, present workout compared with workout goals, and so on. In some cases, this information can be based on information that is input by the user through display options at display interface module 540. For example, display interface module 540 can send a signal through a display interface 544 (see FIG. 5) that prompts a user to answer questions such as the user's weight, age, sex, type of anaerobic activity, desired resistance level, and so forth. The calculation module 575 can then combine this information with repetition data received through the repetition sensor 200 (or with any other relevant aerobic data), as appropriate. After combining and processing the information, calculation module 575 can then pass this information on to the user through the display interface module 540 to a corresponding display (e.g., display 542, 544, etc. of FIG. 5).

The foregoing description relates primarily to one type of repetition sensor having an electricity generator for generating a differential electrical signal indicative of exercise motions. There are, however, a wide variety of repetition sensors that can be used within the context of the present invention.

In another embodiment, the electronic console is configured to identify the distance or intensity of a user exercise motion based on the number of torque spindle rotations over a determined amount of time. For example, an absolute value (not shown) of electrical signal received/detected can be compared with a calibration value to identify the amount or distance of the user's exercise motion. In addition, this absolute value of detected electrical signal divided by time can be used to determine the intensity of the user's exercise motion. The electronic console can then display (not shown) previously-input/calibrated hypothetical values for a given exercise motion and a given amount of exercise weight (e.g., input/calibrated by an exercise trainer). The electronic console can further display (not shown) the user's distance and/or intensity of the given exercise motion compared with the hypothetical values. Thus, the variously-detected electronic signals can be used by the electronic console to provide the user with basic repetition and set data, as well as more complicated pacing-type of exercise information.

Figure 7A:
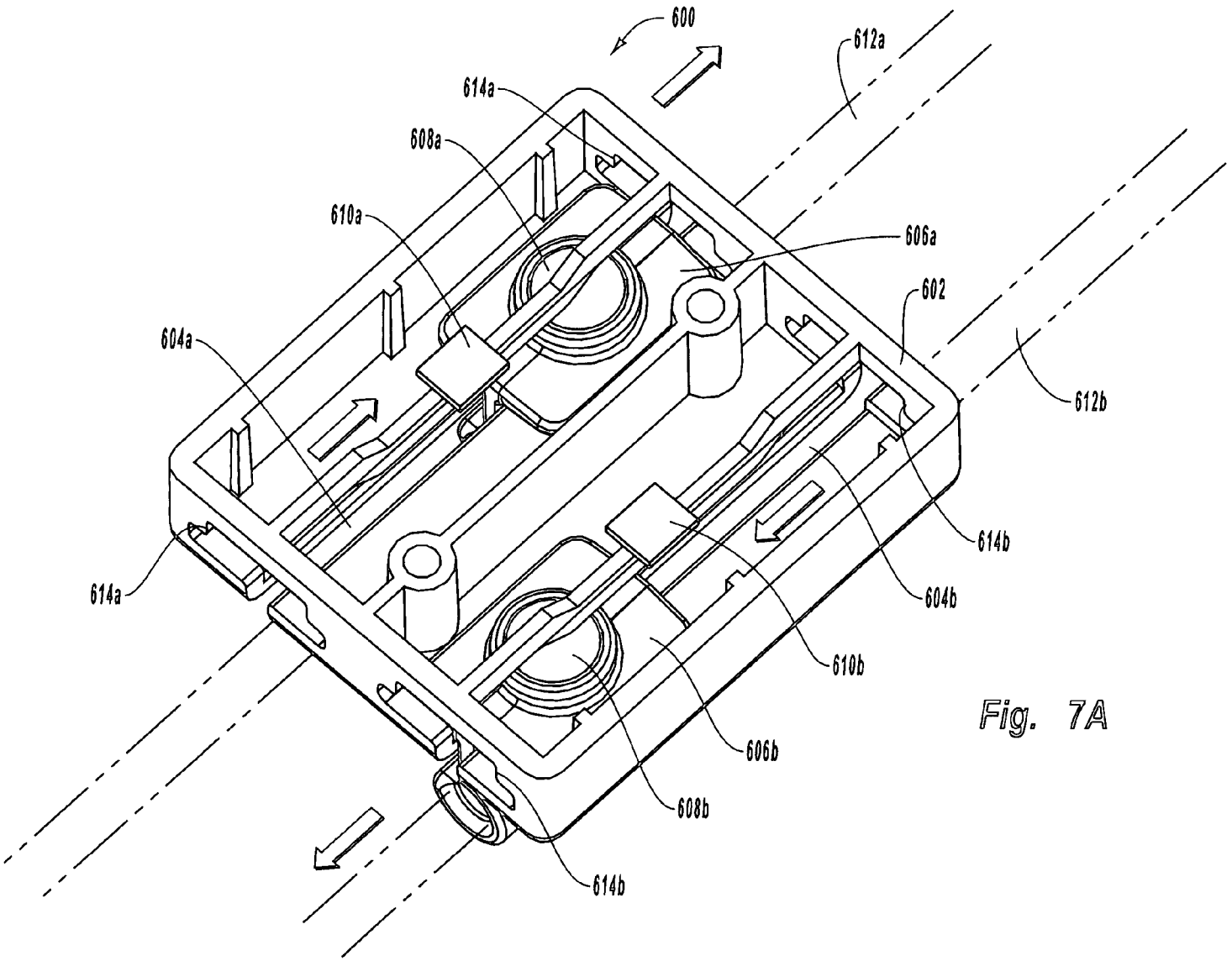
FIG. 7A illustrates another embodiment of a repetition sensor that identifies one or more exercise motions based on one or more magnets and one or more magnetic sensors in a movable carriage system.
Figure 7B:
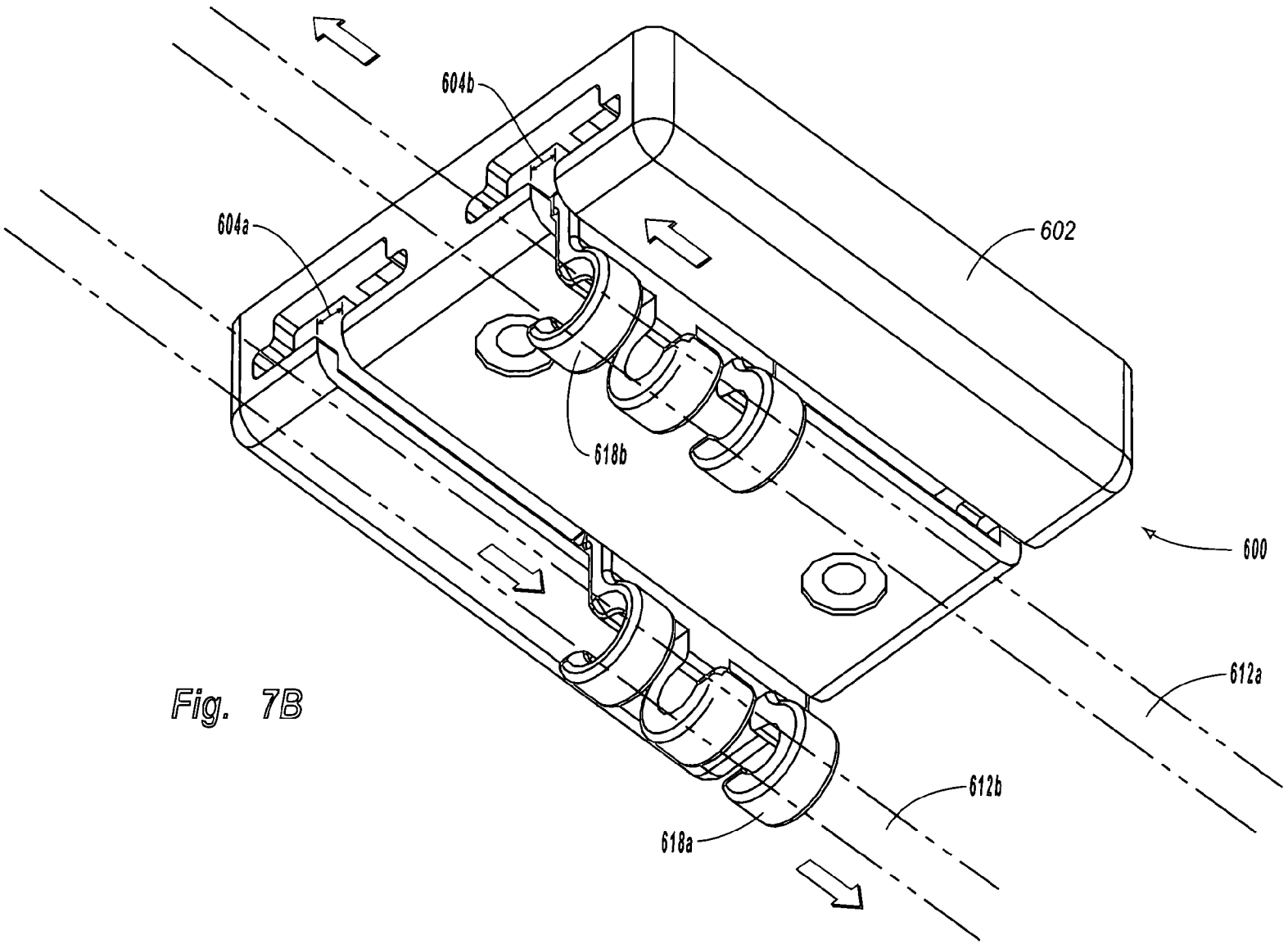
FIG. 7B illustrates a bottom view of the repetition sensor depicted in FIG.

FIGS. 7A and 7B illustrate another embodiment of a repetition sensor that measures one or more exercise repetitions based on varying strengths in a given magnetic field. In particular, repetition sensor 600 illustrated in FIG. 7A comprises a housing 602 and two rails 604*a* and 604*b*, along which two corresponding carriages 606*a* and 606*b* slide back and forth. Carriages 606*a* and 606*b*, rails 604*a* and 604*b*, and housing 602 are each configured so that carriages 606*a* and 606*b* travel in response to an exercise force exerted by a user. Slots 614*a* and 614*b* allow carriages 606*a* and 606*b* to travel inside and outside of housing 602 in one embodiment. In another embodiment, slots 614*a* and 614*b* are blocked, after assembly, such that carriages 606*a* and 606*b* can only travel from one end of housing 602 to the other end of housing 602.

Carriages 606*a* and 606*b* each include a corresponding magnet 608*a* and 608*b* mounted thereon. Magnets 608*a* and 608*b* can include any suitable magnets, such as permanent, rare-earth magnets, iron magnets, or other magnets. In addition, sensors 610*a* and 610*b* are also mounted in housing 602 in proximity of the corresponding carriages 606*a* and 606*b*. Sensors 610*a* and 610*b* are configured to detect ingress and egress of the magnets 608*a* and 608*b*, by virtue of changes in the corresponding magnetic field strengths. Thus, sensors 610*a* and 610*b* detect the movement of magnets 608*a* and 608*b* as the corresponding carriages 606*a* and 606*b* move toward (or away from) the corresponding sensors 610*a* and 610*b*.

In one embodiment, each sensor 610*a* and 610*b* comprises a wire-wound coil (not shown). As magnets 608*a* and 608*b* pass toward (or away from) the corresponding sensors 610*a* and 610*b*, an electrical signal is induced in the corresponding wire-wound coil for each sensor. In particular, as magnets 608*a* and 608*b* approach and retreat from the corresponding sensors 610*a* and 610*b*, the corresponding magnetic field strengths increase and decrease accordingly. This causes the electrical signal induced in each corresponding sensor 610*a* and 610*b* to also change accordingly.

With reference to FIGS. 5-7A, electronic console 115 receives these changes in electrical signal at connection interface 560. Electronic console 115 can then interpret (e.g., via processing module 570) the change in electrical signal as a change in the directional movement of cable 612*a* and 612*b*, or as one or more exercise repetitions, as appropriate. In one embodiment, electronic console 115 further comprises executable instructions in the form of a hysteretic correction, which ensures that a repetition counter is not incremented when an individual hesitates or slightly releases an exercise motion.

FIG. 7B shows that each of the carriages include a cable clasp 618*a* and 618*b*. Clasps 618*a* and 618*b* help facilitate the movement of each carriage 606*a* and 606*b* within housing 602. The corresponding cable clasps 618*a* and 618*b* mount the carriages to corresponding exercise cables 612*a* and 612*b*. In the illustrated embodiment, the cable clasps 618*a* and 618*b* are attached to corresponding exercise cables 612*a* and 612*b* such that they form a non-binding friction fit. The non-binding friction fit allows the exercise cables (e.g., 612*a* and 612*b*) to move the corresponding carriage (e.g., 606*a* and 606*b* of FIG. 7A) from one end of housing 602 to another. The non-binding friction fit, however, also allows the exercise cables (e.g., cable 612*a* and 612*b*) to travel somewhat freely through cable clasps 618*a* and 618*b* after the corresponding carriage has reached, for example, a blocked end of housing 602.

Figure 8:
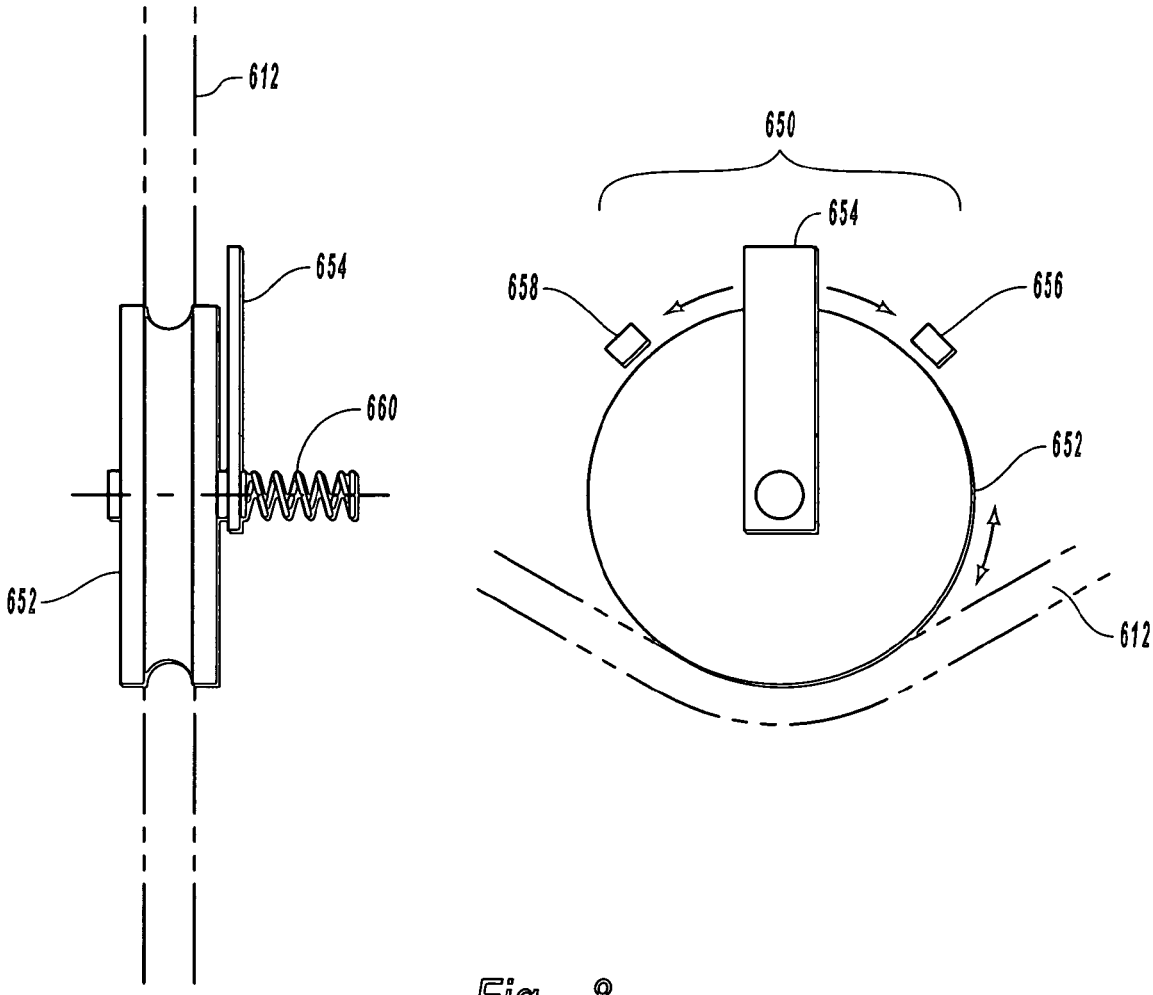
FIG. 8 illustrates a repetition sensor for identifying an exercise motion utilizing a rotatable lever that moves between two or more switches.

FIG. 8 illustrates another embodiment of a repetition sensor 650. In particular, the illustrated repetition sensor 650 comprises a moveable member such as a pulley 652 that is attached to a friction-mounted lever 654. When a user performs an exercise repetition, a corresponding cable 612 rotates pulley 652, which causes lever 654 to rotate in the direction of the travel of cable 612. Lever 654 ceases rotating when it contacts either the forward exercise motion switch 656 or the reverse exercise motion switch 658, as appropriate.

While lever 654 is attached to pulley 652, pulley 652 continues to rotate after lever 654 abuts the corresponding switch 656 or 658. In one embodiment, lever 654 is attached to pulley 652 utilizing a non-binding friction fit allowing somewhat independent rotational movement of lever 654 independent of pulley 652. The amount of non-binding friction can be adjusted using a tensioning device 660. For example, FIG. 8 shows that the illustrated tensioning device 660 comprises a spring, wherein varying amounts of compression of tensioning device 660 control the friction between lever 654 and pulley 652.

When a user performs an exercise motion, lever 654 rotates toward, and ultimately contacts, forward exercise motion switch 656. This closes the forward exercise motion switch 656, and causes a corresponding electrical signal to be sent from positive switch 656. When the individual reverses the exercise motion, lever 654 rotates back towards the reverse, or release, exercise motion switch 658. This opens the forward exercise motion switch 656, and closes the reverse, or release, exercise motion switch 658, causing a corresponding electrical signal to be sent from the reverse, or release, exercise motion switch 658. Electronic console 115 can receive the corresponding signals from each switch at connection interface 560 (see FIG. 6), and interpret the different signals as one or more exercise repetitions.

In one embodiment, electronic console 115 (FIG. 5) includes computer-executable instructions for hysteretic correction of data coming from repetition counter 650. Hysteretic correction can be helpful because a hesitation (or slight release of an exercise motion) will not cause positive switch 656 or negative switch 658 to be actuated. Rather, the corresponding switch is only activated when the exercise motion is long enough for lever 654 to contact the corresponding switch 656 or 658. Other embodiments, however, can include use of magnets and magnetic sensors, using increasing and decreasing magnetic field strengths to identify movements of an exercise repetition.

Figure 9A:
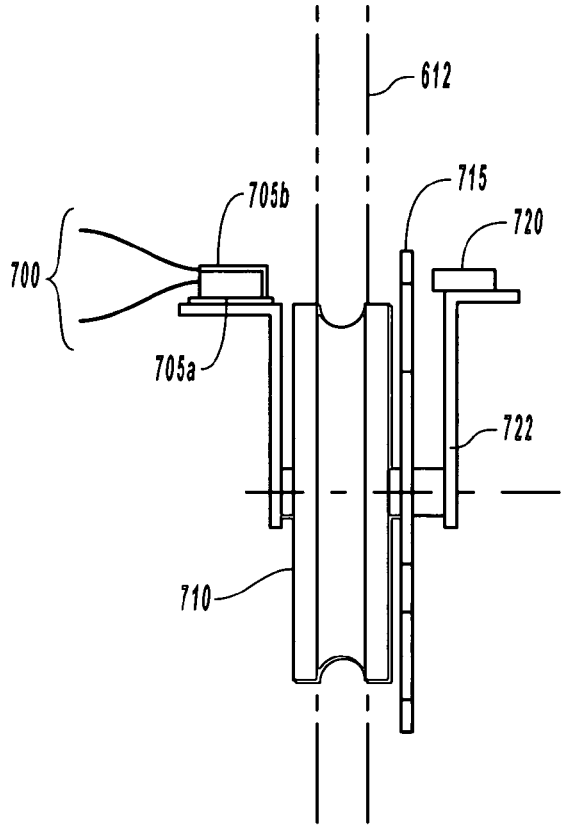
FIG. 9A illustrates a front view of a repetition sensor that identifies an exercise motion based on changes in magnetic fields.
Figure 9B:
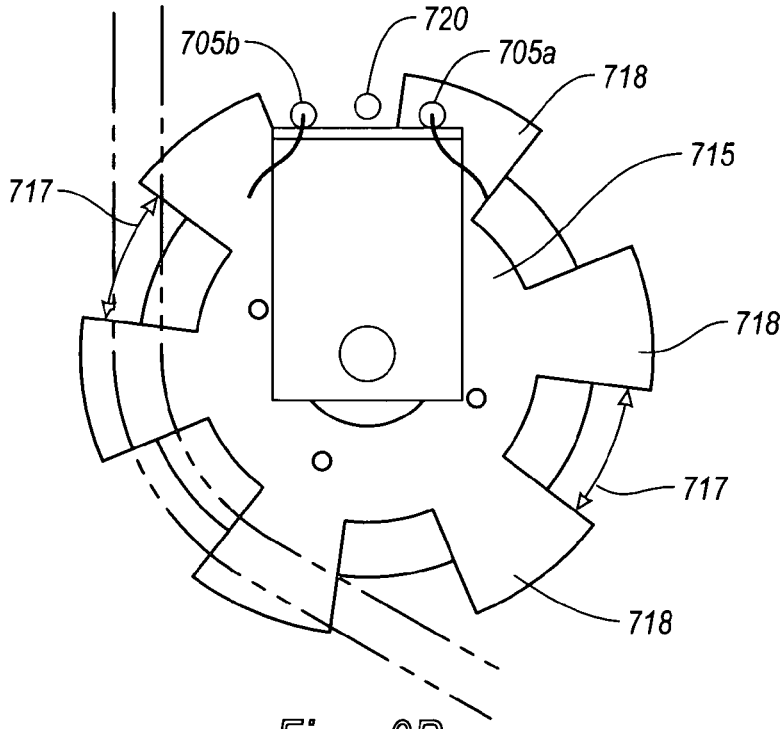
FIG. 9B illustrates a side view of the repetition sensor depicted in FIG. 9A.

FIGS. 9A and 9B provide alternate front and side views of an embodiment of a repetition sensor 700 that incorporates a magnetic sensor system in accordance with the present invention. In particular, the illustrated repetition sensor 700 can be used to monitor the direction of resistance travel, such as the forward exercise motion or reverse, or release, exercise motion of a repetition, the speed of the repetition, the length of the exercise repetition, etc.

As shown, the illustrated repetition sensor 700 comprises two or more individual sensor switches 705*a* and 705*b*, such as two or more Hall-effect reed-type switches that are used to sense a magnetic field from a magnet 720. Repetition sensor 700 is mounted to the frame of the exercise system, or to a bracket (not shown) coupled to the pulley 710. Magnet 720 is held in position using any type of bracket 722 that mounts to an axle or exercise system frame, such that magnet 720 remains in position when pulley 710 rotates.

As also shown, repetition sensor 700 is mounted about pulley 710 to ensure at least an approximate line-of-sight with corresponding magnet 720 on the opposite side of pulley 710. A fan 715, comprising a series of alternating voids 717 and blades 718, is also mounted about pulley 710, such that fan 715 rotates at the same angular speed and direction as pulley 710. A manufacturer, therefore, positions fan 715 such that, as fan 715 rotates, blades 718 block the approximate line-of-sight between magnet 720 and at least one of the sensor switches 705*a* and 705*b*. By contrast, alternating voids 717 allow the approximate line-of-sight to occur between magnet 720 and sensor switches 705*a* and 705*b*. Thus, blades 718 at least partially block sensor switches 705*a* and 705*b* from sensing the magnetic field emanating from magnet 720, and the alternating voids 717 allow the magnetic field to be sensed.

As shown in FIG. 9B, as fan 715 rotates with pulley 710, an alternating void 717 allows the magnetic field produced by the magnet 720 to close the corresponding sensor switch 705*a*, thus forming a closed circuit at sensor switch 705*a*. By contrast, the blade 718 blocks the magnetic field at sensor switch 705*b*, and thus forms an open circuit at the sensor switch 705*b*. The open and closed circuits can be interpreted as logical ones and zeros respectively, which can be used to determine the angular direction of the pulley 710 using quadrature encoding. In alternative embodiments, the foregoing repetition sensor 700, fan 715, and magnet 720 configuration is duplicated with one or more other pulleys, in order to sense similar data for exercises implemented at other portions of the exercise device.

Figure 9D:
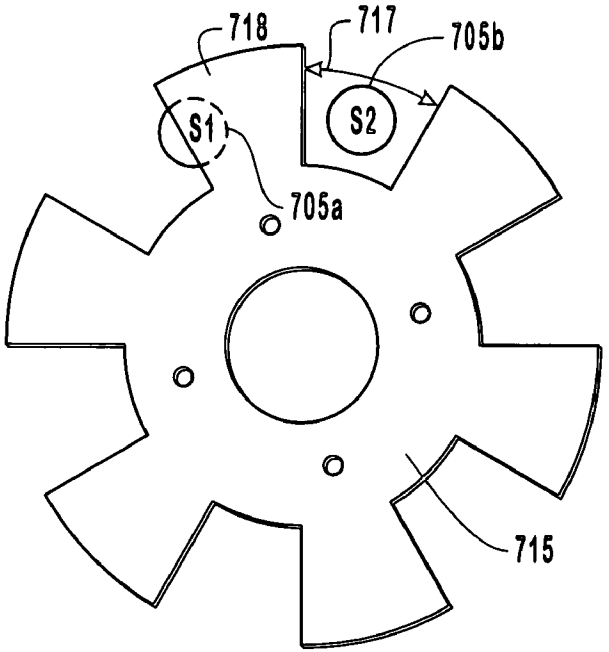
FIGS. 9D and 9DD illustrate the motion and corresponding electrical signals of the apparatus depicted in FIG. 9A, when moving in a clockwise motion.
Figure 9D:
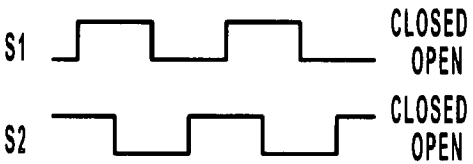
Figure 9C:
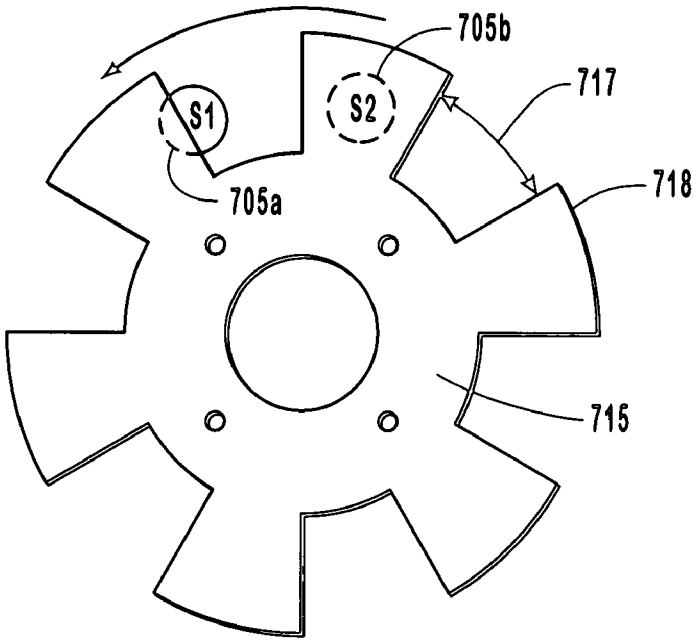
FIGS. 9C and 9CC illustrate the motion and corresponding electrical signals of the apparatus depicted in FIG. 9A, when moving in a counterclockwise motion.
Figure 9C:
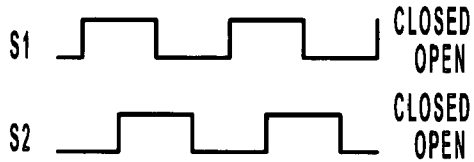

FIGS. 9C and 9D illustrate alternate directions of movement of fan 715 and pulley 710. In particular, FIG. 9C illustrates counterclockwise fan 715 rotation, with FIG. 9CC showing the corresponding electrical signals caused by rotation of fan 715. By contrast, FIG. 9D illustrates clockwise fan 715 rotation, with FIG. 9DD showing the corresponding electrical signals caused by the fan 715 rotation.

For example, as fan 715 rotates in a counterclockwise direction, switch 705*a* ("S1") closes through void 717, while switch 705*b* ("S2") is open due to interference by blade 718. Voids 717 and blades 718 of fan 715 are aligned at consistent intervals, such that sensor switches 705*a* and 705*b* are never both completely open, or both completely closed at the same time. Hence, as shown in FIG. 9CC, electrical signal leaving one sensor switch (e.g., 705*a*) is out of phase with another electrical signal leaving the other sensor switch (e.g., 705*b*). A similar effect occurs, as illustrated in FIGS. 9D and 9DD, showing that, as fan 715 rotates, electrical signal leaves out of phase from one sensor switch (e.g., 705*a*) with the next sensor switch (e.g., 705*b*).

With reference to FIGS. 5-6 and FIGS. 9C, 9CC, 9D and 9DD, these phase differences between the two electrical signals can be identified and processed at a processing module of electronic console 115. For example, to measure stroke length using fan 715, processing module 570 (see FIG. 6) can identify the number of times that a sensor switch 705*a* transitions from open to closed. This data can be correlated using simple geometry to a length of cable 612, based on a known pulley 710 diameter. Thus, a repetition display module 550 (see FIG. 5) can be incremented when processing module 570 (see FIG. 6) identifies a forward exercise motion of a certain length in one direction, and a reverse, or release, exercise motion of a certain length in the opposite direction.

Of course, this information can be used to identify the amount of energy (e.g., work) expended per repetition, since work is the product of force and distance. This energy/work information can also be displayed at electronic console 115, as previously described. Furthermore, repetition sensor 700 can be used to identify the speed at which an individual moves the resistance based on the geometry of the fan, and the length at which a given sensor switch (705*a* and 705*b*) remains open or closed. Thus, electronic console 115 can identify repetition speed to the user, or prompt the user to increase, decrease, or maintain the speed of a given exercise, as appropriate for a routine.

Figure 10B:
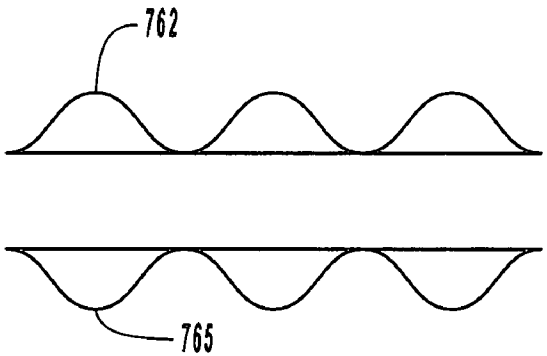
FIG. 10B illustrates one or more electrical currents that can result when operating the repetition sensor of FIG. 10A.
Figure 10A:
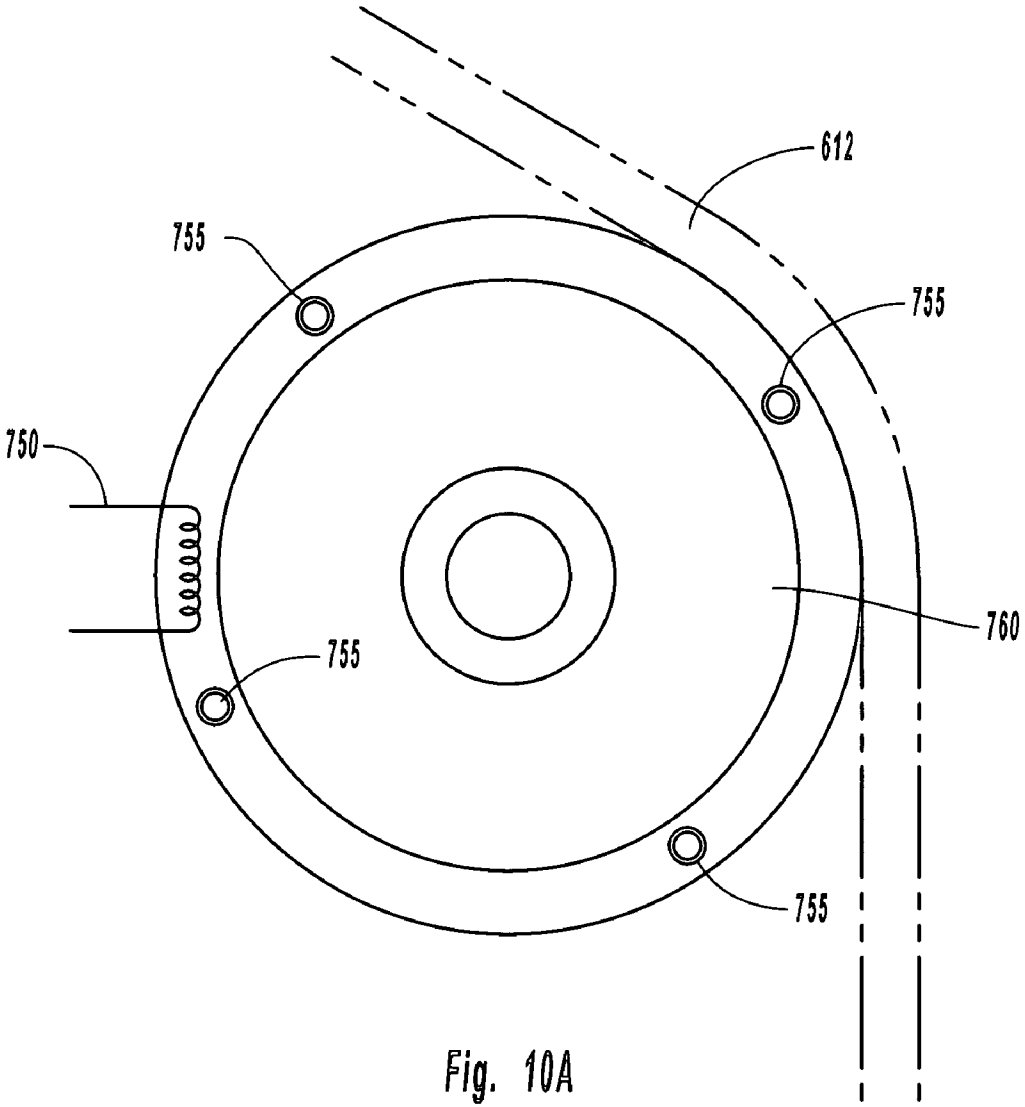
FIG. 10A illustrates a repetition sensor that identifies an exercise motion based on changes in magnetic fields.

FIGS. 10A and 10B illustrate still another example of a repetition sensor that incorporates a magnetic sensor system to detect direction and/or length of an exercise motion. In particular, the repetition sensor shown in FIG. 10A comprises a magnetic coil 750 that is positioned adjacent a pulley 760. Pulley 760 includes a number of magnets 755, mounted with the same polarities facing the same direction, spaced at various points about pulley 760 periphery.

As pulley 760 rotates in a first direction (e.g., clockwise), the movement of each magnetic field emanating from each magnet 755 induces a first electronic signal 762 (FIG. 10B) in the coil 750. When the pulley 760 moves in a second direction (e.g., counterclockwise), a second electronic signal 765 (FIG. 10B) that is equal but opposite in magnitude to the first electronic signal 762 is induced in the coil 750.

Processing module 570 (see FIG. 6) at electronic console 115 (see FIG. 5) can identify a complete repetition when first signal 762 has been present for some length of time, and/or if second signal 765 has been present for some length of time. The peaks of electronic signals 762 and 765 reflect the changing strength of the magnetic field as each magnet 755 approaches and separates from coil 750 when pulley 760 spins. These peaks can be used to calculate speed or stroke length calculations, based on identifying a rotational angle of the pulley 760.

Figure 11:
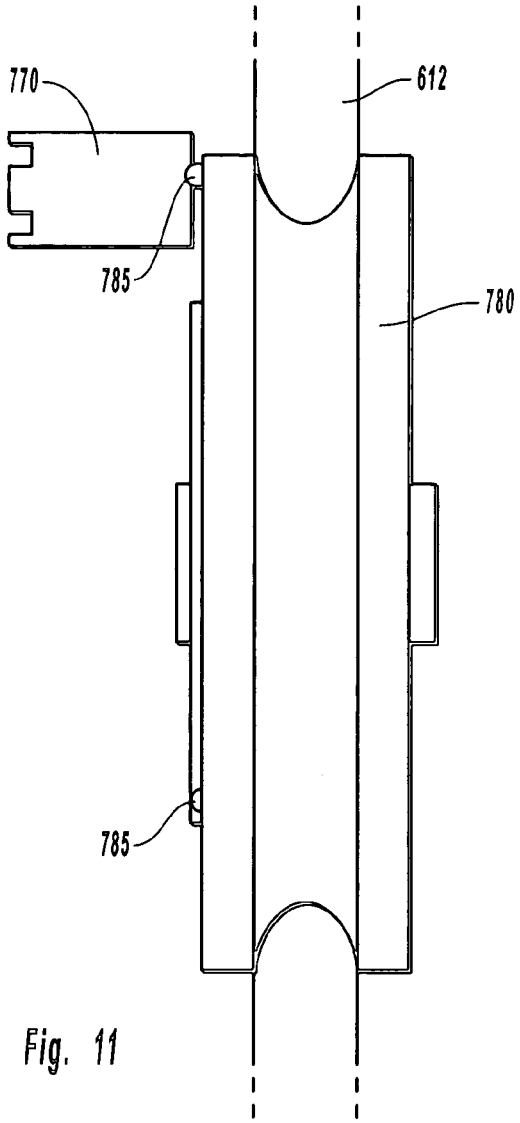
FIG. 11 illustrates a repetition sensor that incorporates a piezoelectric sensor to identify an exercise motion.

FIG. 11 illustrates still another embodiment for identifying an exercise repetition using a piezoelectric sensor. In particular, the properties of the piezoelectric sensor (different electrical signals based on pressure or bending) can be used to identify the direction and distance traveled for a given cable. For example, as shown in FIG. 11, a repetition sensor comprises a piezoelectric sensor 770 that is positioned about a pulley 780. Pulley 780 comprises one or more nubs 785 positioned at various points about the periphery of pulley 780.

As pulley 780 rotates, each of the one or more nubs 785 elastically deforms piezoelectric sensor 770 at least momentarily in one direction until the force is great enough for nub 785 to pass. When the given nub 785 passes by, piezoelectric sensor 770 snaps back into position until it is contacted by another nub 785. When pulley 780 rotates in a reverse direction, this merely causes piezoelectric sensor 770 to bend back in the opposite direction, as appropriate for each nub 785.

Each time piezoelectric sensor 770 is bent, piezoelectric sensor 770 sends a got corresponding electrical signal(s) to electronic console 115 (see FIG. 5) via circuit wires (not shown) connected to electrical connection interface 560 (see FIG. 6). The processing module 570 can then interpret and/or process the received electrical signal as appropriate. For example, processing module 570 (see FIG. 6) can deduce the amount that pulley 780 has rotated, and in what direction, based on the number and type of piezoelectric sensor 770 bends. Processing module 570 (see FIG. 6) can then use information obtained from piezoelectric sensor 770 to calculate an exercise motion length, the length of an exercise repetition, and/or the speed at which an exercise is being performed.

Figure 12:
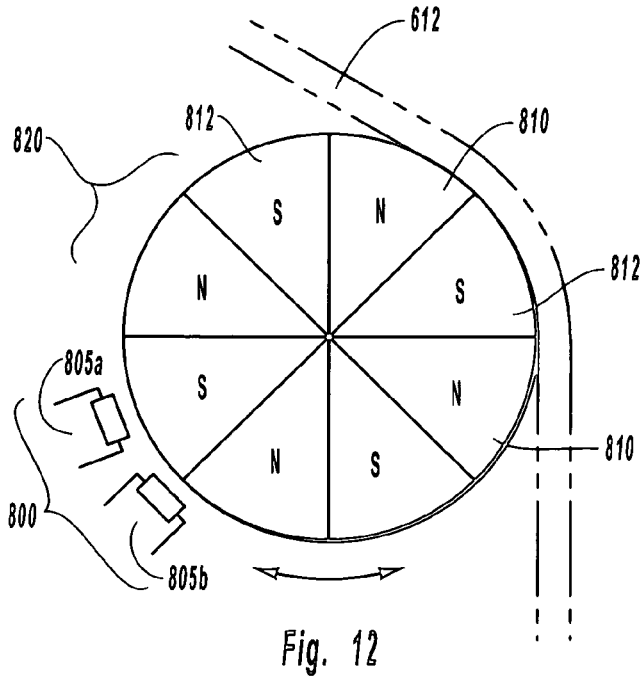
FIG. 12 illustrates a repetition sensor that identifies an exercise motion based on changes in magnetic fields.

FIG. 12 illustrates yet a further embodiment of repetition sensor 800 that incorporates a magnetic sensor system using Hall-Effect sensors 805*a* and 805*b*, such as reed switches, to sense one or more magnetic fields emanating from a rotating pulley 820. In particular, FIG. 12 illustrates that a pulley 820 for use in an anaerobic exercise system comprises alternating north magnetic sections 810, and south magnetic sections 812. In an alternative embodiment, north magnetic sections 810 and south magnetic sections 812 emanate from a separate magnetic wheel that is secured to the pulley 820.

As pulley (or wheel) 820 moves in response to a user's exercise force, north magnetic sections 810 and south magnetic sections 812 rotate past sensor 805*a* and 805*b*, causing the relevant sensor switches to open and close their respective circuits in sequence. This sequential opening and closing of each sensor switch circuit produces a set of electronic signals that are out of phase from one sensor (e.g. 805*a*) to the next sensor (e.g. 805*b*). These signals, therefore, can be interpreted using quadrature encoding at processing module 570 (see FIG. 6), as previously described, to determine repetition length, repetition duration, and so forth.

Figure 13:
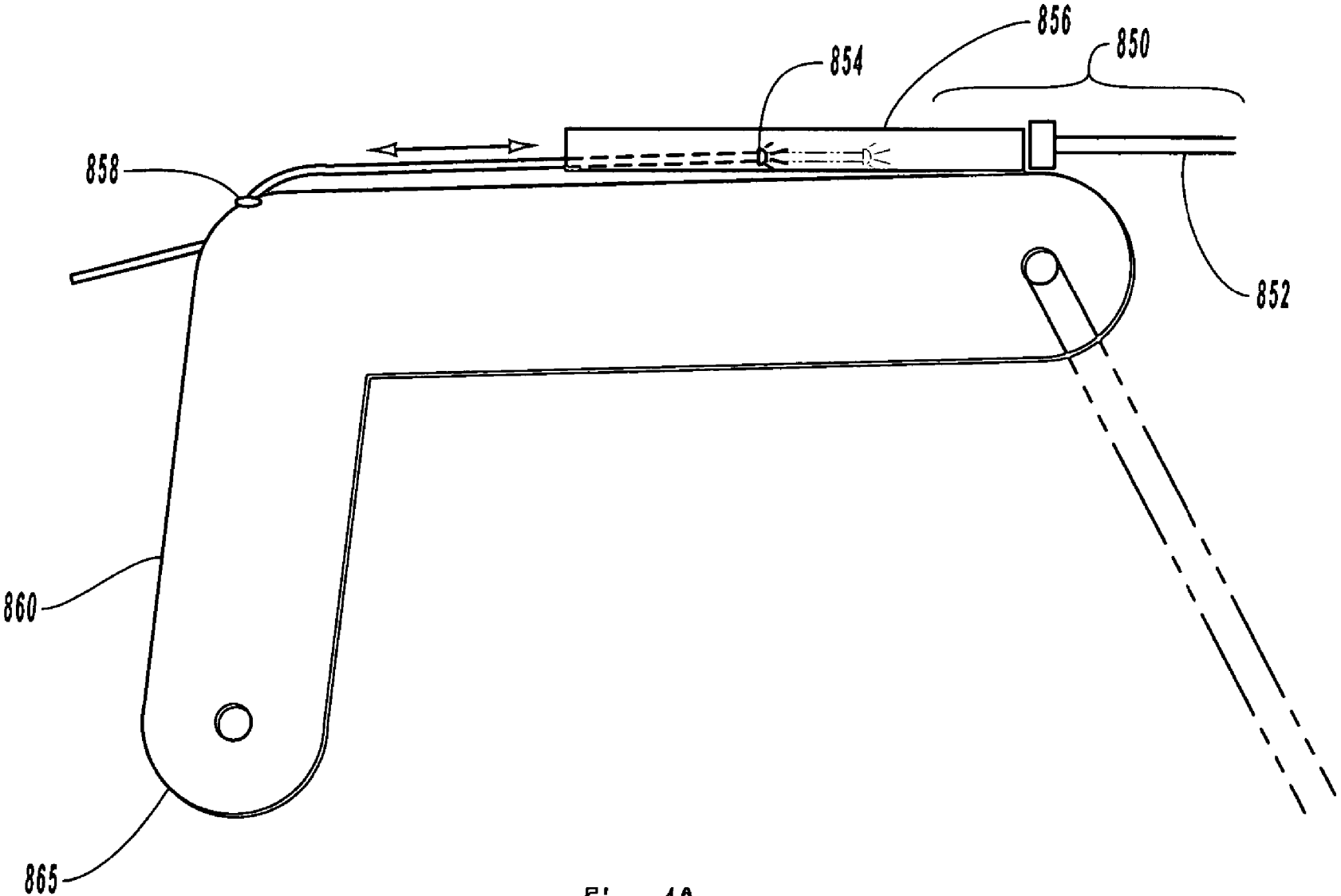
FIG. 13 illustrates a repetition sensor that utilizes optical intensity to identify an exercise motion.

FIG. 13 illustrates an embodiment of a repetition sensor 850 that uses an optical sensor system to identify anaerobic exercise information. In particular, a repetition sensor 850 comprises a photo resistor 852 that is positioned about an optical tube 856 comprising a movable optical source 854. The movable optical source 854 is connected to a retractable or stiff wire 858, which in turn is connected to a mechanical lever 860, (in alternative embodiments the positions of optical source 854 and photo resistor 852 can be moved). Mechanical lever 860 is mounted about a mounting point 865 in a rotatable fashion. When mechanical lever 860 rotates in response to an exercise force exerted by the user, mechanical lever 860 pulls or pushes stiff wire 858 backward or forward inside optical tube 856.

The pushing and pulling of stiff wire 858 causes optical source 854 to move toward or away from photo resistor 852. When optical source 854 is closer to photo resistor 852, the electrical resistance for an electrical circuit at photo resistor 852 increases. By contrast, when optical source 854 moves away from photo resistor 852, the electrical resistance of the electrical circuit at photo resistor 852 decreases. These changes in electrical resistance translate into corresponding changes in the strength of the passing electrical signal. Processing module 570 (see FIG. 6) can then interpret and/or calculate the changes in electrical signal as it is received through electrical connection interface 560 at electronic console 115 (see FIG. 6).

Accordingly, the foregoing figures and description provide a number of ways in which anaerobic exercise data can be identified. Furthermore, each of the foregoing embodiments can be incorporated flexibly to any type of anaerobic exercise device with relative ease. For example, magnetic, mechanical, optical, piezoelectric, and other known sensors can be interchanged in the illustrated embodiments, as appropriate, such that one type of sensor depicted with magnetics can be interchanged with optical sensors, piezoelectric sensors, and so forth. As such, embodiments of the present invention allow a manufacturer to provide significant advantages to a user in terms of identifying the progress in a given workout, and for keeping track of prior workout activities.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A repetition sensor for use in an exercise device comprising:

a repetition movement member linked to a movable component of the exercise device, the repetition movement member configured to move in response to a mechanical stimulus generated during repetition movement; and an electricity generator linked to the repetition movement member such that the electricity generator generates an electrical signal indicative of the repetition movement in response to movement of the repetition movement member, wherein the electricity generator is a direct current generator; and an electronic console, wherein the electronic console identifies that the repetition member has been moved based on the direction of the electrical signal.

2. The repetition sensor as recited in claim 1, further comprising a sensor frame for securing the repetition sensor to an exercise device and a torque spindle linking the repetition movement member to the electricity generator, the torque spindle rotating in response to movement of the repetition movement member and facilitating generation of an electrical signal at the electricity generator.

3. The repetition sensor as recited in claim 1, wherein the electricity generator comprises one or more magnets, such that electrical signal is created by rotation of at least one of the one or more magnets.

4. The repetition sensor as recited in claim 3, wherein the electricity generator outputs a greater intensity of electrical signal as the torque spindle rotates with greater speed.

5. The repetition sensor as recited in claim 1, wherein the electricity generator comprises a first circuit wire and a second circuit wire, and wherein one exercise repetition is based on an instance of greater electronic energy potential on the first circuit wire than on the second circuit wire.

6. The repetition sensor as recited in claim 1, wherein the electricity generator is an alternating current generator.

7. The repetition sensor as recited in claim 6, further comprising an electronic console, wherein the electronic console identifies that the movable component has been moved based on the amplitude of the electrical signal.

8. The repetition sensor as recited in claim 6, wherein the electricity generator comprises a first circuit wire and a second circuit wire, and wherein amplitude of the electrical signal is measured across both the first circuit wire and the second circuit wire.

9. The repetition sensor as recited in claim 7, wherein the electronic console includes an electrical connection interface module for receiving electronic signals from a repetition sensor;

a processing module communicably connected to the electrical connection interface module, wherein the processing module identifies a signal property of an electrical signal generated by the repetition sensor; and a display interface module communicably connected to the processing module, wherein the display interface module provides an indication of an exercise repetition based on the identified signal property to one or more display interfaces.

10. The electronic display console as recited in claim 9, wherein the repetition sensor is an apparatus comprising an AC current generator, a DC current generator, a piezoelectric sensor, an optical resistor, or a Hall-Effect sensor switch.

11. The electronic display console as recited in claim 9, wherein the signal property identifies the direction of a direct current emanating from one of a plurality of circuit wires that are electrically coupled to the repetition sensor. An exercise system configured to display repetition data comprising:

an exercise system having a resistance assembly;

a movable member linked to the resistance assembly, the movable member moving in response to movement of the resistance assembly during exercise; and a means for generating a signal representing repetition movement of the resistance assembly, wherein the means for generating a signal is linked to the movable member, wherein the means for generating a signal comprises a radio frequency generator.

12. The electronic display console as recited in claim 9, wherein the signal property identifies an amplitude of an alternating current emanating from one or more circuit wires that are electrically coupled to the repetition sensor. An exercise system configured to display repetition data comprising:

an exercise system having a resistance assembly;

a movable member linked to the resistance assembly, the movable member moving in response to movement of the resistance assembly during exercise; and a means for generating a signal representing repetition movement of the resistance assembly, wherein the means for generating a signal is linked to the movable member, and wherein the means for generating a signal comprises a magnetic signal generator.

13. The electronic display console as recited in claim 9, wherein the one or more display interfaces further comprise a display for any one of a level of anaerobic resistance, a number of exercise sets, a duration of anaerobic exercise, a heart rate, a user weight, a prior anaerobic exercise goal, a present anaerobic exercise goal, and a projected anaerobic exercise goal.

14. The electronic display console as recited in claim 9, wherein the processing module comprises an identification module configured to identify the signal property, and a calculation module configured to interpret the signal property as an exercise repetition.

15. The electronic display console as recited in claim 14, wherein the calculation module is further configured to compare the signal property with one or more of a prior number of exercise repetitions, an exercise set, an exercise resistance, a user anaerobic exercise activity, a hypothetical anaerobic exercise goal for a given resistance weight, a user heart rate, and a user anaerobic exercise duration.

16. The electronic display console as recited in claim 15, wherein the display interface module is configured to receive user input, and wherein the calculation module is further configured to compare one or more of the signal property with a prior anaerobic exercise goal, a present anaerobic exercise goal, a projected anaerobic exercise goal, a hypothetical anaerobic exercise goal for one or more of a given resistance weight, a user weight, a user age, a user sex, a user heart rate, and exercise data from an aerobic exercise device.

17. The repetition sensor of claim 1, further comprising a linkage coupled to the movement member, a torque spindle linked to the linkage and to the electricity generator, the torque spindle rotating in response to movement of the movement member, the rotational movement of the torque spindle representing the movement of the movement member, wherein the electrical signal is generated in response to rotational movement of the torque spindle to represent movement of the movable member.

18. The repetition sensor of claim 17, wherein the torque spindle is configured to rotate in a first and second direction in response to repetition movement of the exercise system.

19. The repetition sensor of claim 18, wherein the electricity generator generates an electrical signal having a positive voltage when the torque spindle rotates in the first direction.

20. The repetition sensor of claim 18, wherein the electricity generator generates an electrical signal having a negative voltage when the torque spindle rotates in the second direction.

21. The repetition sensor as recited in claim 18, wherein the linkage comprises one of a ribbon, a cable, a string, a wire, and a gear.

22. The repetition sensor as recited in claim 19, wherein the linkage comprises a pulley.

23. The repetition sensor as recited in claim 19, wherein the linkage comprises a zip line.

24. The repetition sensor as recited in claim 23, wherein the zip line is an exercise cable extending from a gripping handle, such that the electricity generator generates the electrical signal as an exercise cable moves in response to motion at a gripping handle linked to the exercise cable.

25. The repetition sensor as recited in claim 17, wherein the linkage comprises an electronic sensor.

26. The repetition sensor as recited in claim 17, wherein the linkage comprises a magnetic sensor.

27. The repetition sensor as recited in claim 17, wherein the electricity generator is selected from the group comprising a direct current generator, an alternating current generator, a magnetic sensor system, an optical sensor system, or a piezoelectric sensor that produces an electrical signal in response to an exercise motion.

28. The repetition sensor as recited in claim 17, further comprising an electronic console which identifies that the movable member has been moved based on at least one of the direction of the electrical signal, the amount of the electrical signal, the intensity of the electrical signal, and the amplitude of the electrical signal.

29. The repetition sensor as recited in claim 17, wherein the electricity generator comprises a first circuit wire and a second circuit wire, and wherein one exercise repetition is based on a greater electronic energy potential on the first circuit wire than on the second circuit wire.

30. The repetition sensor as recited in claim 17, wherein the electricity generator comprises an alternating current generator.

31. The repetition sensor as recited in claim 30, further comprising an electronic console wherein the electronic console identifies that the movable member has been moved based on the amplitude of the electrical signal.

32. The repetition sensor as recited in claim 17, wherein the torque spindle is linked through a self-winding ribbon to an exercise component that moves in proportion to a force applied to the exercise system.

33. The repetition sensor as recited in claim 32, further comprising a rewind spring which rotates the torque spindle in a reverse direction to self-wind the ribbon.

34. The repetition sensor as recited in claim 17, wherein the electricity generator generates an electrical signal of differential intensity as the movable member moves at a corresponding differential speed.

35. A repetition sensor for use in an exercise device comprising:

a repetition movement member linked to a movable component of the exercise device, the repetition movement member configured to move in response to a mechanical stimulus generated during repetition movement; and an electricity generator linked to the repetition movement member such that the electricity generator generates an electrical signal indicative of the repetition movement in response to movement of the repetition movement member, wherein the repetition movement member comprises a retractable ribbon.

36. The repetition sensor as recited in claim 35, wherein the retractable ribbon is coupled to a rewind spring, such that the retractable ribbon is retracted when the rewind spring moves to a relaxed state.

* * * * *

UNITED STATES PATENT AND TRADEMARK OFFICE

CERTIFICATE OF CORRECTION

PATENT NO. : 7,628,737 B2
APPLICATION NO. : 10/916687
DATED : December 8, 2009
INVENTOR(S) : Kowallis et al.

It is certified that error appears in the above-identified patent and that said Letters Patent is hereby corrected as shown below:

Title page, item (*) Notice: Subject to any disclaimer, the term of this patent is extended or adjusted under 35 U.S.C. 154(b) by 504 days.

Delete the phrase "by 504 days" and insert --by 918 days--

Column 4
Line 43, after "FIG." insert --7A--

Column 5
Line 28, change "a" to --an--

Column 7
Line 17, change "FIG. 5" to --FIGS. 2B and 2C--
Line 25, after "lever arm" insert --520--

Column 8
Line 1, change "or" to --of--

Column 10
Line 1, change "than" to --that--

Column 11
Line 45, change "spindle more" to --spindle to rotate more--

Column 17
Line 50, before "corresponding" remove [got]

Column 19
Lines 65-67, after "repetition sensor." remove [An exercise system configured to display repetition comprising: an exercise system having a resistance assembly;]

Signed and Sealed this

Seventh Day of September, 2010

David J. Kappos

David J. Kappos
*Director of the United States Patent and Trademark Office*

Column 20
Lines 1-8, remove [a movable member linked to the resistance assembly, the movable member moving in response to movement of the resistance assembly during exercise; and a means for generating a signal is linked to the movable member, wherein the means for generating a signal comprises a radio frequency generator.]
Lines 12-23, remove [An exercise system configured to display repetition data comprising: an exercise system having a resistance assembly; a movable member linked to the resistance assembly, the movable member moving in response to movement of the resistance assembly during exercise; and a means for generating a signal representing repetition movement of the resistance assembly, wherein the means for generating a signal is linked to the movable member, and wherein the means for generating a signal comprises a magnetic signal generator.]

Column 21
Line 8, change “19” to --17--
Line 10, change “19” to --17--